US005854988A

United States Patent [19]

Davidson et al.

[11] Patent Number: 5,854,988

[45] Date of Patent: Dec. 29, 1998

[54] METHOD FOR CONTROLLING AN EXCAVATOR

[75] Inventors: Richard W. Davidson, Danville; Vernon J. Brabec, Livermore, both of Calif.

[73] Assignee: Topcon Laser Systems, Inc., Pleasanton, Calif.

[21] Appl. No.: 658,702

[22] Filed: Jun. 5, 1996

[51] Int. Cl.[6] ..... G06F 19/00; E02F 3/34

[52] U.S. Cl. ..... 701/50; 37/414; 414/699

[58] Field of Search ..... 701/50; 37/414, 37/415, 416; 414/699; 172/4.5

[56] References Cited

U.S. PATENT DOCUMENTS

| | | | |
|---|---|---|---|
| 4,866,641 | 9/1989 | Nielson et al. | 701/50 |
| 5,404,661 | 4/1995 | Sahm et al. | 701/50 |
| 5,438,771 | 8/1995 | Sahm et al. | 701/50 |
| 5,446,980 | 9/1995 | Rocke | 414/699 |
| 5,461,803 | 10/1995 | Rocke | 414/699 |
| 5,493,798 | 2/1996 | Rocke et al. | 701/50 |
| 5,682,312 | 10/1997 | Rocke | 701/50 |

*Primary Examiner*—Gary Chin
*Attorney, Agent, or Firm*—Limbach & Limbach L.L.P.

[57] ABSTRACT

A method of using a touch screen control panel to input and display data to control excavation by an excavator includes the steps of: (1) providing a display panel with a touch-sensitive screen at a position accessible to an operator; (2) inputting data by touching the display panel to define a desired contour of the excavated surface; (3) displaying on the display panel information representing the desired contour of the excavated surface; and (4) controlling movement of the excavator bucket to excavate the desired contour of the excavated surface. The display panel displays a sequence of screens that convey information to the operator and permit the operator to select operational modes and to input data to define the control parameters for the various operational modes.

34 Claims, 24 Drawing Sheets

METHOD FOR CONTROLLING AN EXCAVATOR

BACKGROUND OF THE INVENTION

This invention relates generally to machine control systems for excavators, and relates more particularly to a method of using a touch screen control panel to input and display data to control an excavator.

DESCRIPTION OF THE RELEVANT ART

Excavators are digging machines, typically mounted on tracks. An excavator has a bucket mounted at the end of a two member linkage. One of the links, called a boom, is pivotally mounted to a machine base and extends outward in an upward direction. The other link, called a stick, is pivotally mounted at one end to the outer end of the boom and extends downward from the boom pivot. The bucket is pivotally mounted to the outer end of the stick. Three hydraulic cylinders independently move the boom, the stick, and the bucket under the control of an operator or a machine control system. Another hydraulic drive rotates the machine base relative to the track to permit repositioning the bucket for operations like dumping.

Operating an excavator efficiently requires a skilled operator. Each of the couplings between the machine base, boom, stick, and bucket are pivots, so extending or retracting any single hydraulic cylinder or actuator causes the digging edge of the bucket to move in an arc. Most excavating projects, however, involve creating finished surfaces that are planar, either horizontal or sloped. Thus multiple cylinders need to be controlled simultaneously in order to excavate planar surfaces with the bucket. Typically, two joysticks are used by the operator, each joystick moveable left and right to control extension and retraction of one cylinder and moveable forward and aft to control extension and retraction of another cylinder.

One problem encountered with an excavator is how to indicate to the operator the depth to which the cutting edge of the bucket is digging so that the correct elevation or grade is obtained by the excavation process. A related problem is that the cutting edge of the bucket can be out of sight of the operator. One known way to indicate depth is to utilize angular sensors that measure the relative angles between the machine base, boom, stick, and bucket, and to calculate the depth of the bucket, using principles of geometry, given the measured angles and the lengths of the links. The calculated depth is then displayed for the operator, as disclosed, for example, in U.S. Pat. No. 4,129,224.

An extension to this concept is to utilize the measured depth and/or slope information to automatically control the movement of the excavator bucket. In U.S. Pat. No. 4,129,224, for example, the hydraulic cylinder that moves the stick is controlled by the operator, and the machine control system automatically controls the boom cylinder and the bucket cylinder to result in a linear movement of the bucket.

Such prior excavator machine control systems have lacked an efficient device for inputting depth and slope settings and for displaying the position of the bucket during the excavation process.

SUMMARY OF THE INVENTION

In accordance with the illustrated preferred embodiment, the present invention provides a method of using a touch screen control panel to input and display data to control excavation by an excavator. The basic method comprises the steps of: (1) providing a display panel with a touch-sensitive screen at a position accessible to an operator; (2) inputting data by touching the display panel to define a desired contour of the excavated surface; (3) displaying on the display panel information representing the desired contour of the excavated surface; and (4) controlling movement of the excavator bucket to excavate the desired contour of the excavated surface.

The display panel displays a sequence of screens that convey information to the operator and permit the operator to select operational modes and to input data to define the control parameters for the various operational modes. The display panel is touch sensitive, so data entry is made by the operator touching the panel at various locations defined by the various screens. The display panel and its method of inputting and displaying data are intended to be used with an excavator machine control system that measures the angles between the machine base, boom, stick, and bucket, and that controls the hydraulic cylinders to guide the excavator bucket to dig to a desired contour.

As an initial matter, the method permits the input and display of data during a system set-up mode of operation. During the system set-up, a system set-up menu screen is displayed that enables the operator to choose from several set-up routines. One system set-up routine is a diagnostic test, which can be initiated by touching the display panel at a box labeled "Test." A diagnostic test is run by the machine control system and the results are displayed by another screen. Another system set-up routine is selection of measurement units. Touching a portion of the screen labeled "Unit" will cause another screen to appear that permits the operator to choose between meters and feet for distance measurements. Another system set-up routine is a technician's menu, which is accessed during an initial calibration procedure involving the geometry of the excavator and the measurements of the angle sensors.

A fourth system set-up routine permits the operator to define characteristics of multiple buckets and to select which bucket is in use at any particular time. Touching a portion of the system set-up screen labeled "Bucket Setup" causes the display panel to display a screen with multiple boxes, one for each bucket. Pressing one of those boxes causes the display panel to display a calibration screen that permits the operator to input data that establishes the relevant geometry of the bucket so that the machine control system knows where the cutting edge of the bucket is positioned.

Many of the screens have boxes labeled "Help," and pressing the help box of a screen causes the display panel to display other screens with explanatory information intended to assist the operator. Pressing a box labeled "Exit" on a help screen will return the operator to the previous screen.

The operator accesses the operational modes from the system set-up menu screen by pressing a box labeled "Next Mode." Continuing to press the "Next Mode" box causes the display panel to scroll through all of the operational modes and back to the system set-up mode. There are three fundamental modes of operation of the method of the present invention—slope mode, depth mode, and laser mode. Repeatedly pressing the next mode box will scroll through the slope mode, depth mode, laser mode, and system set-up mode in sequence.

The operational modes each have a set-up screen and an indicate screen. The set-up screen is used to input depth or slope data to the machine control system, while the indicate screen displays the actual bucket position relative to the desired contour during excavation. Data is entered to set up an operational mode by the operator touching the screen at boxes labeled on the screen. A digital value is entered for the desired slope or depth by pressing one or more boxes until the displayed value equals the desired value. After an operational mode is set up, the operator presses a trigger switch to activate the automatic machine control and to display the indicate screen. If the trigger switch is not depressed, the display will switch to the indicate screen five seconds after the last entry through the touch panel. The indicate screen shows the desired contour by a line and associated depth or slope data, and shows a graphical representation of the actual bucket position, as determined by the machine control system, relative to the desired contour.

The features and advantages described in the specification are not all inclusive, and particularly, many additional features and advantages will be apparent to one of ordinary skill in the art in view of the drawings, specification and claims hereof. Moreover, it should be noted that the language used in the specification has been principally selected for readability and instructional purposes, and may not have been selected to delineate or circumscribe the inventive subject matter, resort to the claims being necessary to determine such inventive subject matter.

DETAILED DESCRIPTION OF THE PREFERRED EMBODIMENT

FIGS. 1 through 24 of the drawings depict various preferred embodiments of the present invention for purposes of illustration only. One skilled in the art will readily recognize from the following discussion that alternative embodiments of the structures and methods illustrated herein may be employed without departing from the principles of the invention described herein.

Figure 1:
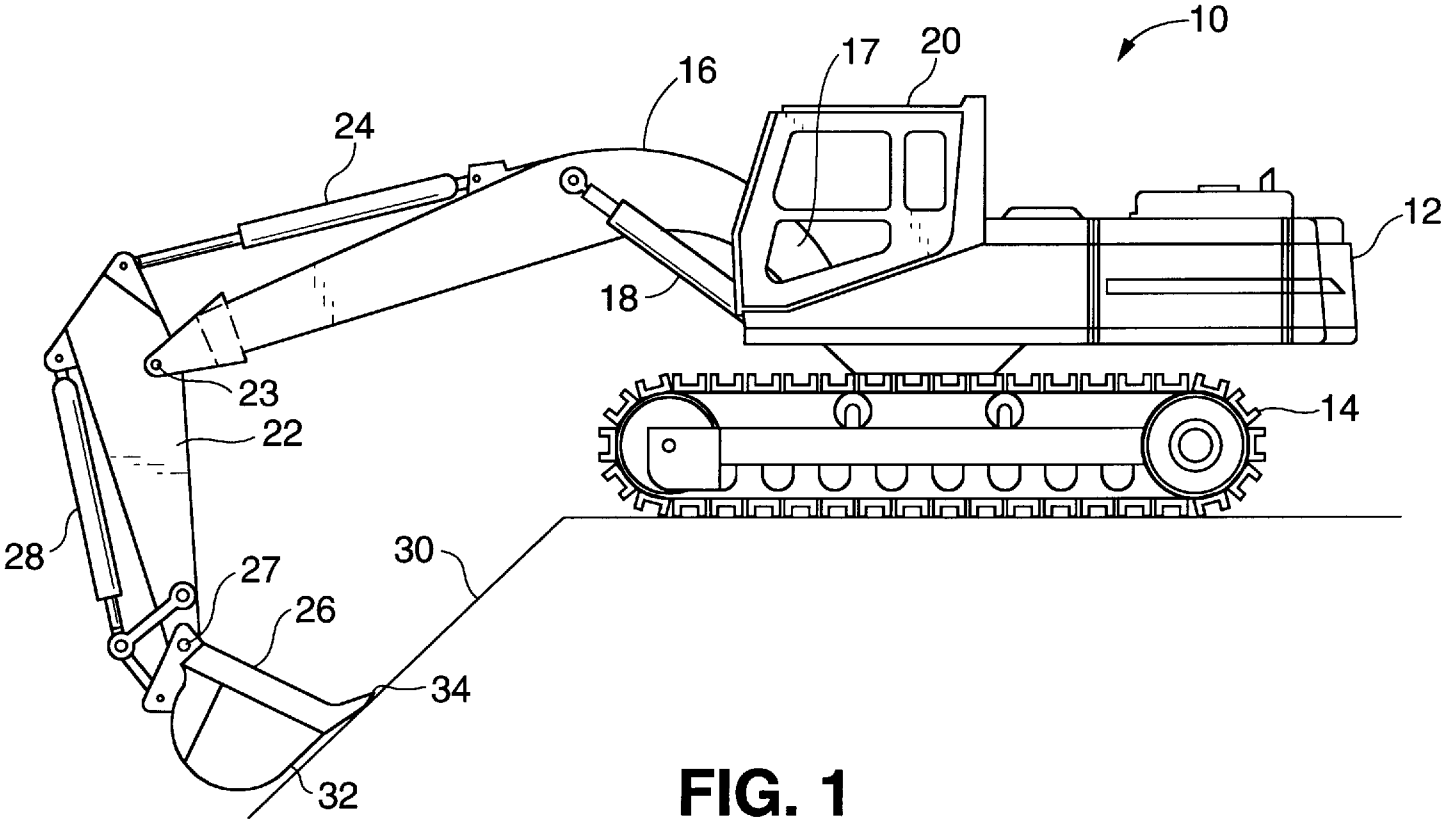
FIG. 1 is a side elevation view of an excavator grading a slope.

The preferred embodiment of the present invention is a method of using a touch screen control panel to input and display data to control excavation by an excavator. As shown in FIG. 1, an excavator 10 comprises a machine base 12 that is rotatably mounted on tracks 14. A boom 16 is pivotally mounted at pivot 17 on the machine base 12 and extends outward. A hydraulic cylinder 18 (or a pair of cylinders), controlled by an operator sitting in a cab 20 or by a machine control system, moves the boom relative to the machine base about the pivot 17 during the excavation process. A stick 22 is pivotally mounted at pivot 23 to the outer end of the boom 16. Similarly, a hydraulic cylinder 24 moves the stick relative to the boom about the pivot 23 during excavation. A bucket 26 is pivotally mounted at pivot 27 to an outer end of the stick 22. A hydraulic cylinder 28 moves the bucket relative to the stick about the pivot 27 during excavation.

The excavator 10 is shown in FIG. 1 digging a slope 30. Note that a bottom surface 32 of the bucket 26 is preferably parallel to the slope 30. The bucket 26 has a cutting edge 34 that digs into the earth during excavation.

Figure 2:
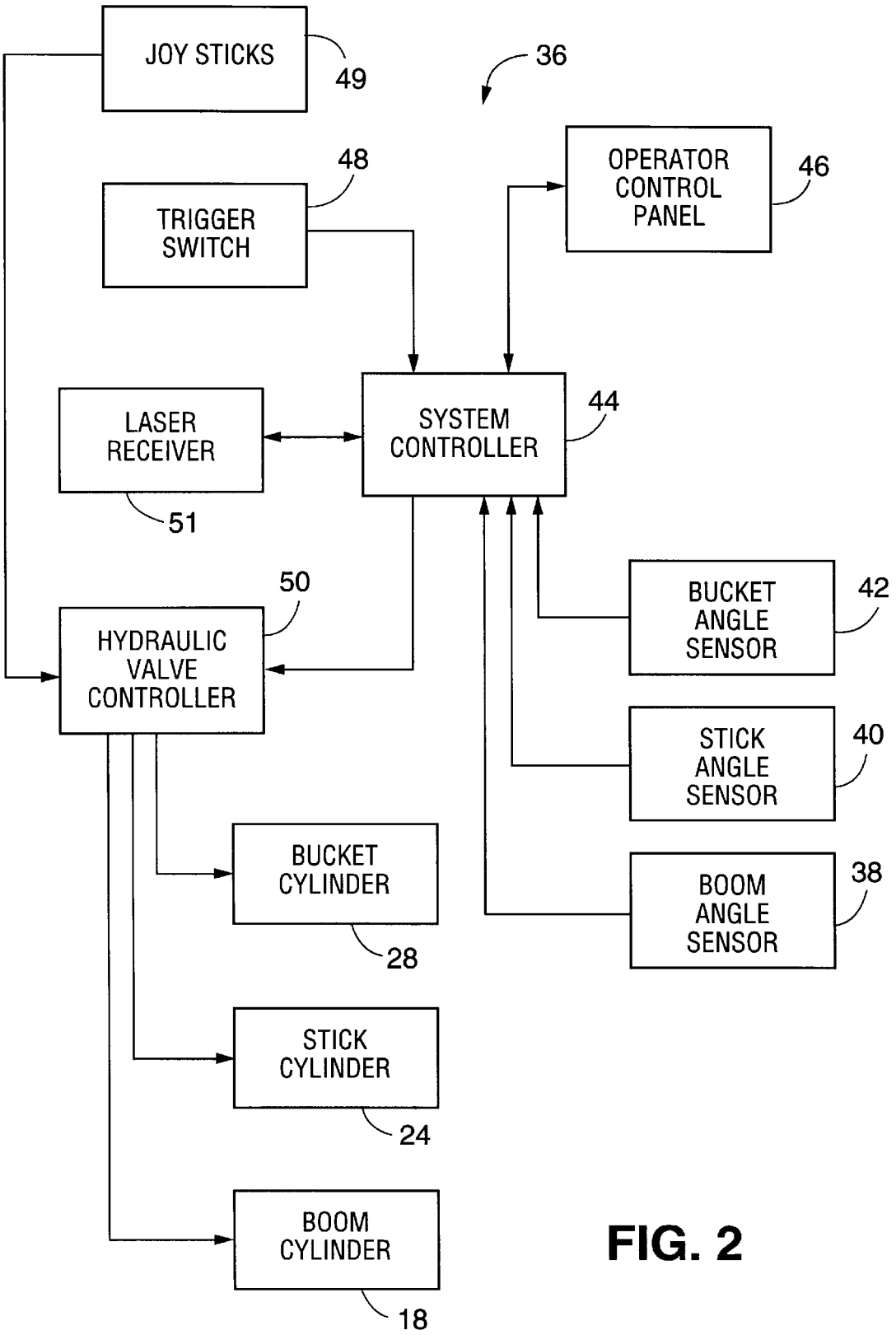
FIG. 2 is a block diagram of a machine control system which is used in conjunction with the method of the present invention.

FIG. 2 is a block diagram of a machine control system 36 that utilizes the method of the present invention. The machine control system 36 includes three angle sensors 38, 40, and 42, that provide data to a system controller 44 about the angles of the boom 16, stick 22, and bucket 26, respectively. The sensors are mounted on the excavator near the pivots 17, 23, and 27 of the boom, stick, and bucket, respectively. The system controller 44 is a programmed processor that determines the actual position of the bucket during excavation by knowing the angles measured by the angle sensors and the geometries of the boom 16, stick 22, and bucket 26. The operation of the system controller 44 in that regard is well known in the art and is not further disclosed herein. The system controller 44 is coupled to an operator control panel 46 and a trigger switch 48, which will be discussed in more detail below. The system controller 44 sends control signals to a hydraulic valve controller 50, which controls the movement of the boom cylinder 18, stick cylinder 24, and bucket cylinder 28. A laser receiver 51 is optionally included in the machine control system. The laser receiver 51 detects the elevation at which a reference laser beam strikes a mast mounted to the excavator, thus providing an elevation reference.

The block diagram of FIG. 2 also shows a pair of joysticks 49 that provides a manual control input to the hydraulic valve controller 50. The operator moves the joysticks to control the movement of the bucket, stick, and boom cylinders when operating under manual control. Under automatic control, in the preferred embodiment, the operator manually controls the stick cylinder 24 only, and the system controller 44 automatically controls the bucket cylinder 28 and the boom cylinder 18 to excavate to the desired slope or depth.

The operator control panel 46 provides a means for inputting data from the operator to the system controller 44 to define the operational parameters of the machine control system 36. The control panel 46 also provides a display of information to the operator so that the operator can monitor the excavation process, whether controlled manually by the operator or automatically by the machine control system 36.

Figure 3A:
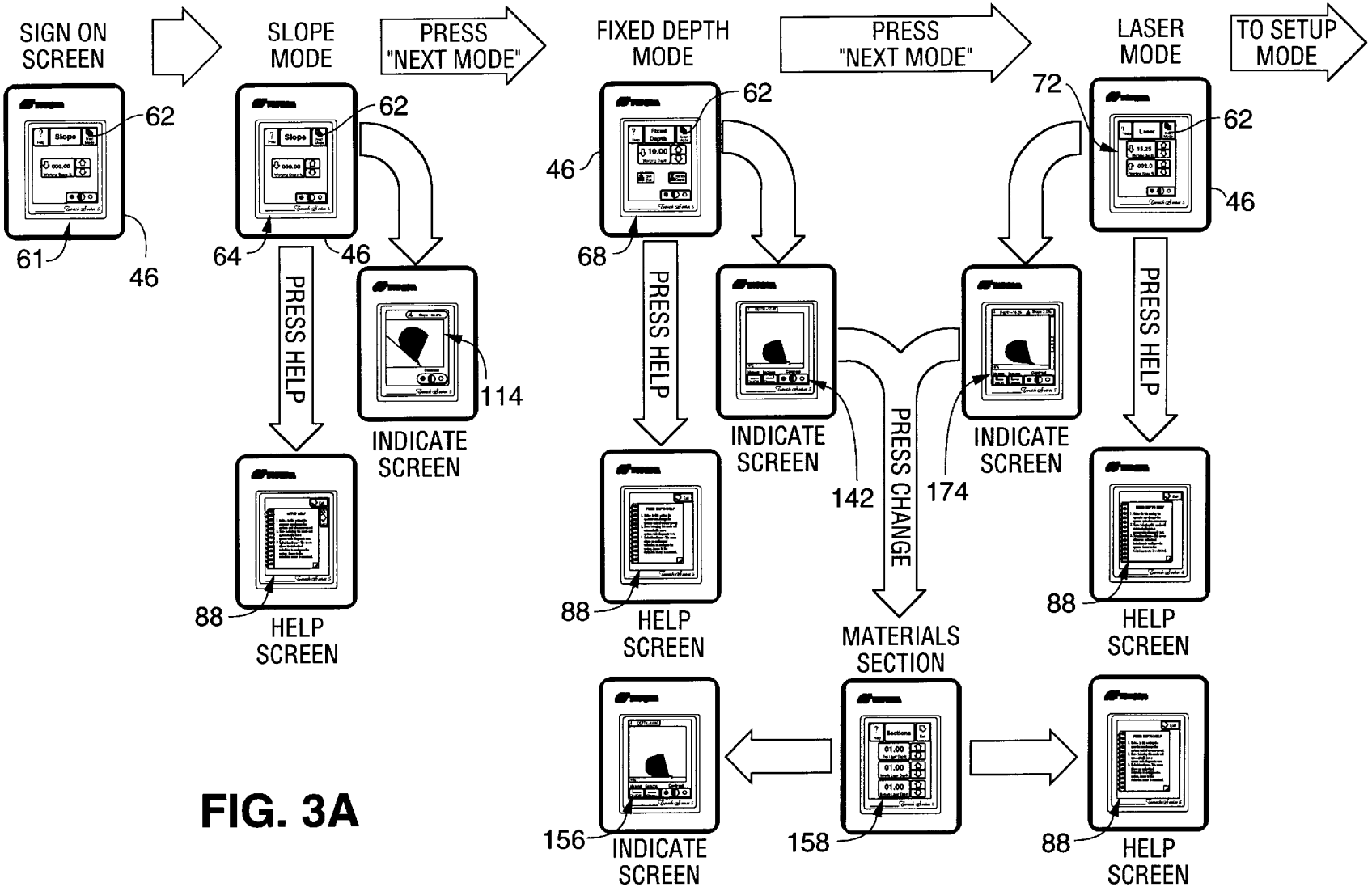
FIGS. 3A and 3B are screen diagrams of the present invention.
Figure 3B:
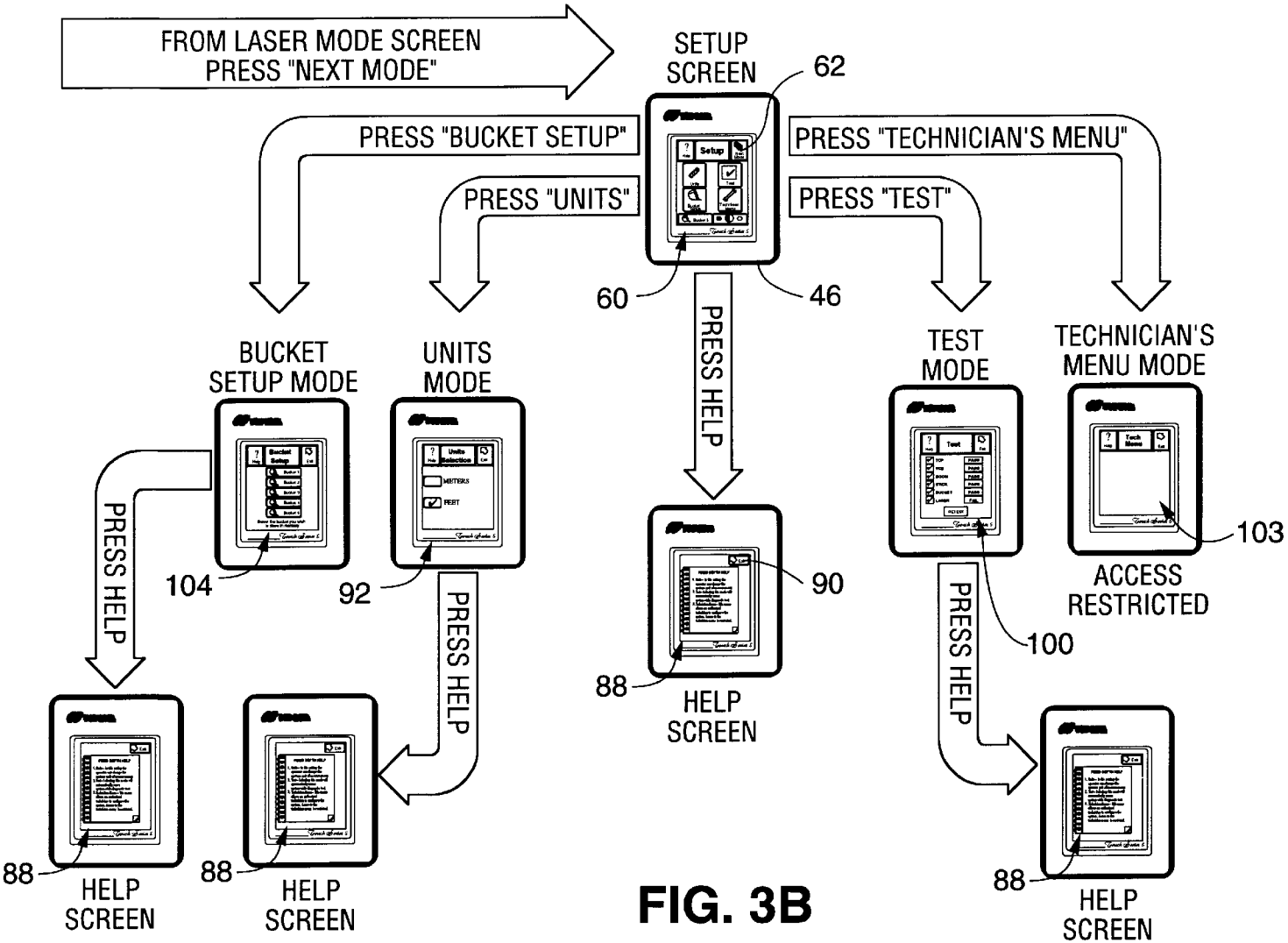

FIGS. 3A and 3B illustrate some of the screens displayed by the control panel 46 during operation of the method of the present invention. Four set-up screens 60, 64, 68, and 72 are sequentially accessible to the operator by touching a box labeled "Next Mode." Upon initial power-up, the control panel 46 displays a screen 61 that is the same as whatever screen was displayed when the system was last powered down. By touching the "Next Mode" box 62 on the screen 61, a slope set-up screen 64 appears. Touching the "Next Mode" box 62 on the slope set-up screen 64 causes a setup screen 68 for the depth mode to appear. Similarly, touching the "Next Mode" box 62 on the depth-mode set-up screen 68 causes the laser-mode set-up screen 72 to appear. Touching the "Next Mode" box 62 on the laser-mode set-up screen 72 makes a system set-up screen 60 appear. Finally, touching the "Next Mode" box 62 on the system set-up screen 60 makes the slope set-up screen 64 reappear.

The operation of the system set-up mode is illustrated in FIGS. 3B and 4 through 8. As best shown in FIG. 5A, the system set-up screen 60 includes the "Next Mode" box 62, a "Help" box 76, a contrast box 78, a bucket select box 122, and four functional boxes 80, 82, 84, and 86. Touching the "Next Mode" box 62 changes the screen to the slope-mode set-up screen 64, as described above. Touching the "Help" box 76 changes the screen to display a textual explanation of the system set-up procedure to assist the operator in operating the system, as shown in FIGS. 5B and 5C. If the help screen 88 has multiple pages of information to display, a "Next Page" box is provided to allow the operator to advance through the screens, and a "Prev Page" box is provided to return to previously displayed screens. The Help screen 88 has an "Exit" box 90 that returns the display to the system set-up menu screen 60 when the box 90 is touched. The "Help" box 76 is an input box that is common to most of the set-up and indicate screens. Help screens 88 appear throughout the screen sequences disclosed in FIG. 3 (and are also shown in detail in FIGS. 5B, 5C, 10B, 13B, and 23A–C), but apart from the textual content, all the help screens operate the same way as described above.

The contrast box 78 (FIG. 5A) of the system setup menu screen is another input box that is common to many of the screens. Touching the left side of the contrast box 78 darkens the contrast of the screen, while touching the right side of the box lightens the contrast of the screen. This permits the operator to adjust the contrast of the screen to suit the viewing and lighting conditions.

Figure 6:
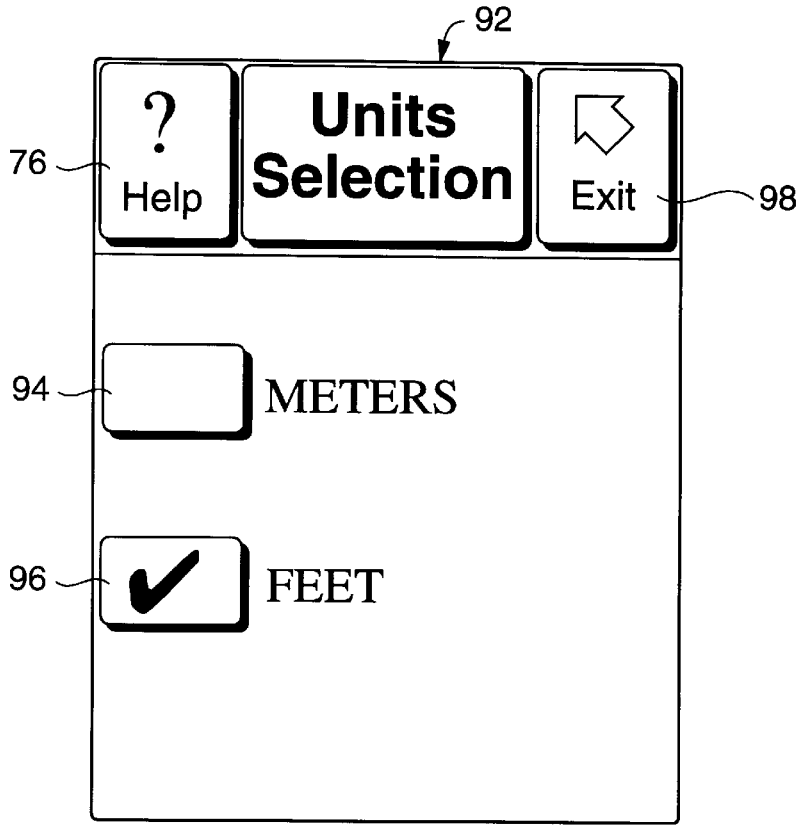
FIG. 6 is a screen used to select units in the system set-up mode.
Figure 7:
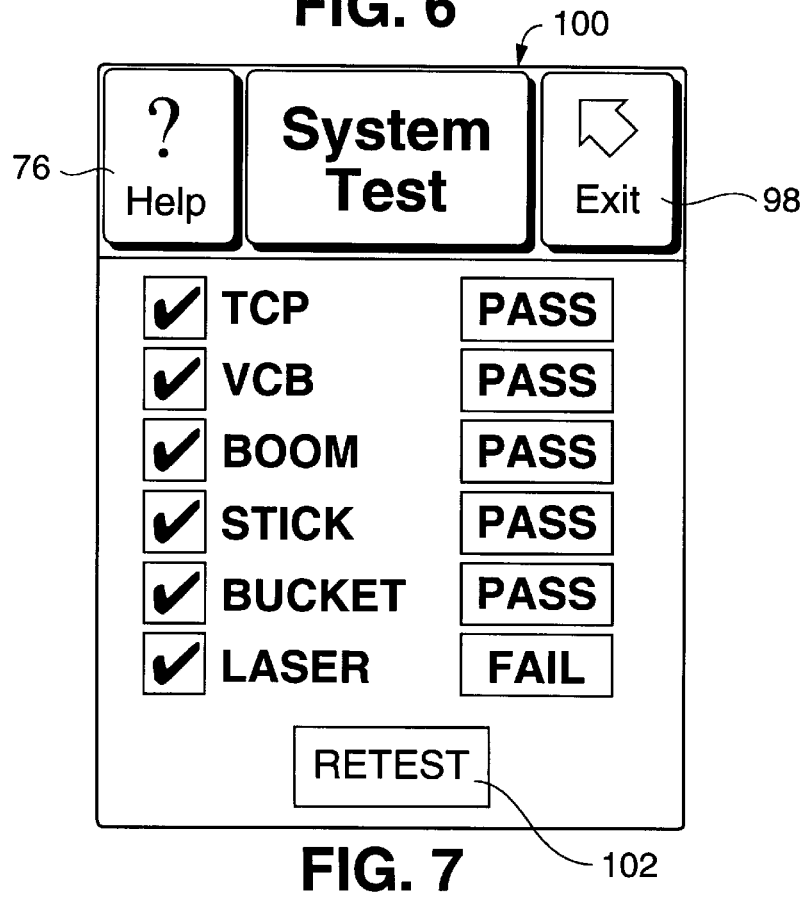
FIG. 7 is a screen used to indicate the results of a system test in the system set-up mode.

Functional box 80 of the system set-up menu screen 60 (FIG. 5A) is labeled "Units." Touching this box changes the screen to a units selection screen 92, shown in FIG. 6. The units selection screen 92 has two boxes 94 and 96, one of which selects meters as the unit of distance measurement and the other of which selects feet as the unit of distance measurement. Once the selection has been made, the operator touches the "Exit" box 98 to return to the system set-up menu screen 60.

Functional box 82 of the system set-up menu screen 60 (FIG. 5A) is labeled "Test". Touching this box changes the screen to a system test screen 100, shown in FIG. 7, and directs the system controller 44 to perform a series of tests on the operator control panel 46, the valve controller 50, the angle sensors 38, 40, and 42, and the laser receiver 51. The test results are indicated on the system test screen 100. If the operator wants to repeat the test, touching a box labeled "Retest" 102 will cause that to happen. Once the testing is completed, the operator touches the "Exit" box 98 to return to the system set-up menu screen 60.

Functional box 84 of the system set-up menu screen 60 (FIG. 5A) is labeled "Technician Menu". Touching this box causes a password screen 103 (FIG. 5D) to be displayed. Once the proper password is input by a trained technician, access is provided to additional screens for calibrating the sensors and entering geometric data into the system controller 44.

Functional box 86 of the system set-up menu screen 60 (FIG. 5A) is labeled "Bucket Setup". Touching this box changes the screen to a bucket set-up screen 104, shown in FIG. 8A, and gives the operator the ability to define the geometries of up to five different buckets. To enter the characteristics of a bucket, the operator touches one of the "Bucket" boxes 106 on the screen, and another series of screens, shown in FIGS. 8B–D appear, which steps the operator through the process of entering the appropriate data.

Figure 8A:
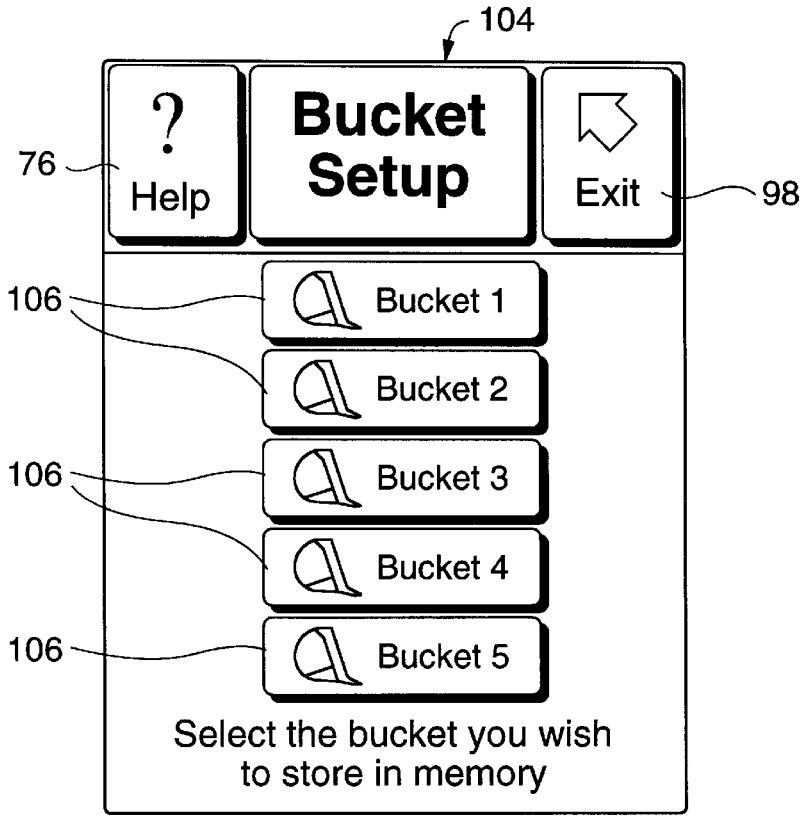
FIG. 8A is a screen used to select a bucket in the system set-up mode, and screens 8B, 8C, and 8D are screens used to input information for the bucket selection.
Figure 8B:
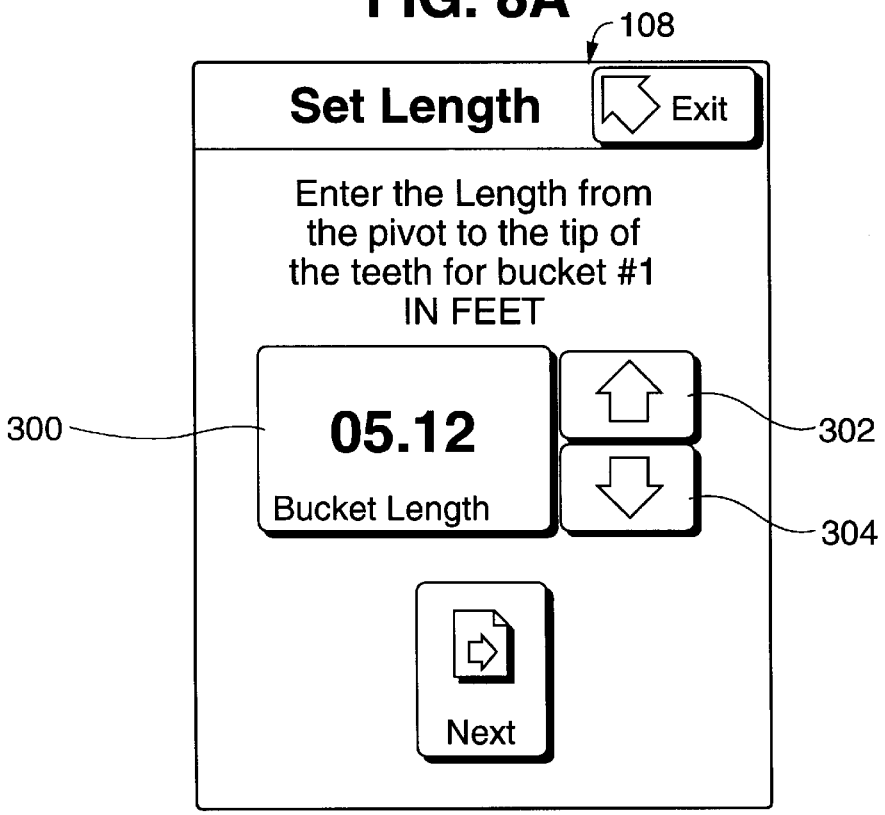
Figure 8C:
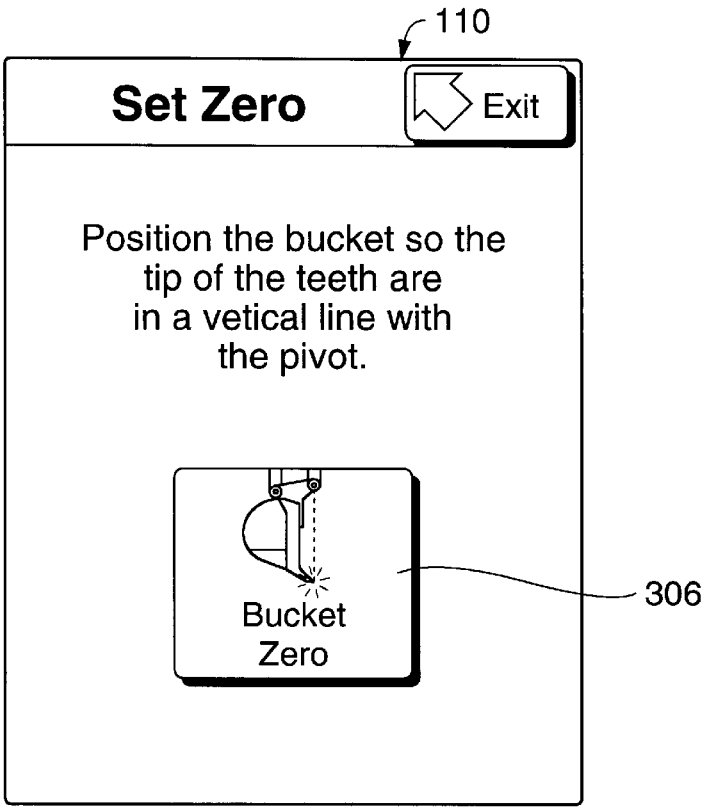
Figure 8D:
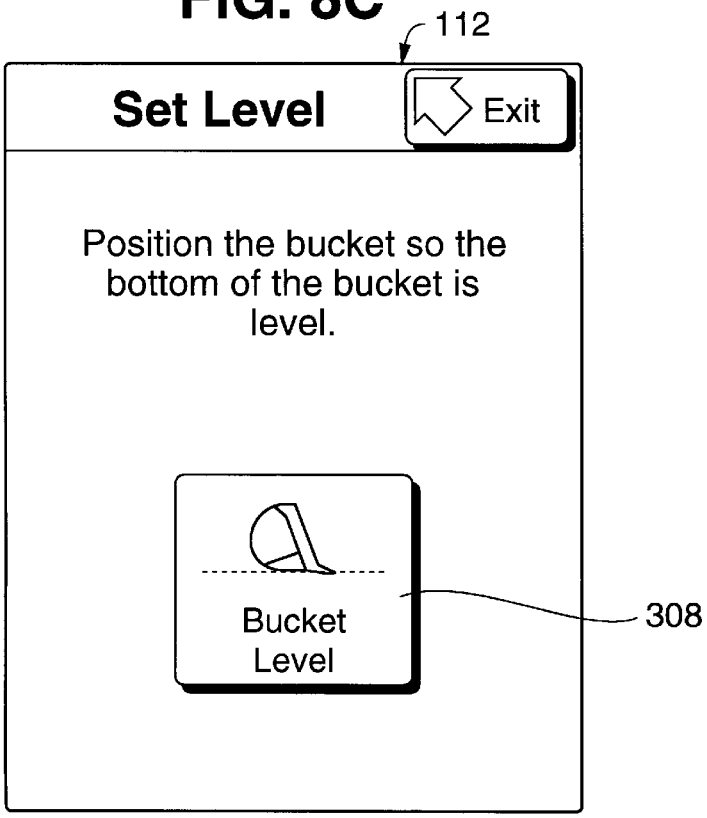

As shown in FIG. 8B, one screen 108 of the bucket set-up procedure sets the length of the bucket as measured between the pivot point 27 and the cutting edge 34. Box 300 indicates a value for the bucket length. Boxes 302 and 304 are touched by the operator to input the bucket length value. Then a box labeled "Next" is touched to proceed to the next step.

The next screen 110 (FIG. 8C) sets a zero position for the bucket. The operator positions the bucket 26 so that the cutting edge 34 is vertically below the pivot point 27 and then touches the screen at box 306. This enables the machine control system 36 to determine the bucket angle at which the cutting edge is directly below the pivot point.

The third screen 112 (FIG. 8D) in the bucket setup sets a level position for the bucket. The operator positions the bucket 26 so that its bottom surface 32 is horizontal. The operator then touches the screen at box 308 to indicate to the machine control system 36 to measure the bucket angle and store that measurement as the horizontal position of that bucket. The bucket setup procedure can be repeated for multiple buckets. Once the characteristics of a bucket are entered into the system, they are stored and used whenever that bucket is selected. This permits the rapid change of buckets during an excavation without having to recharacterize the bucket or recalibrate the system.

The system set-up menu screen 60 (FIG. 5A) indicates in the bucket select box 122 which bucket has been selected. At this time the operator can change buckets, if desired. The bucket select box 122 on the slope mode set-up screen can be touched by the operator to sequentially move through the list of buckets that have been entered into the system. Of course the operator will have to physically make the change to the new bucket, but will not have to reenter the calibration data.

Figure 9:
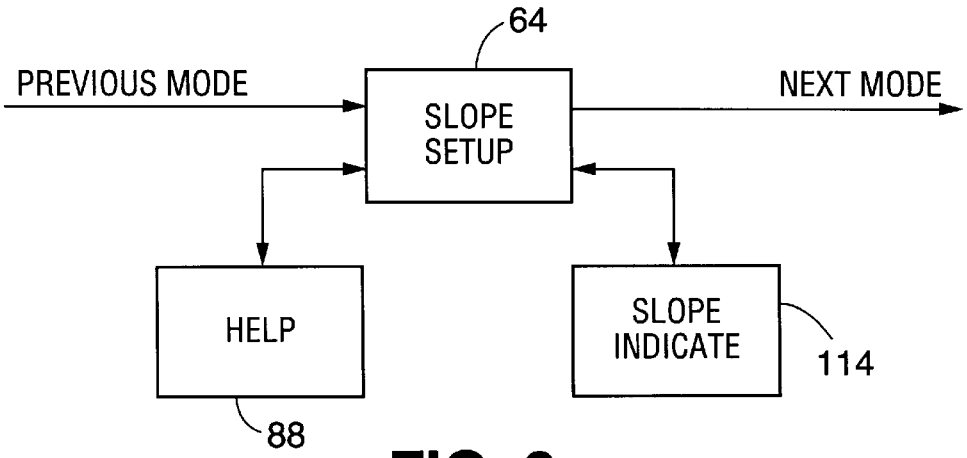
FIG. 9 is a screen diagram of a slope mode of operation of the present invention.
Figure 4:
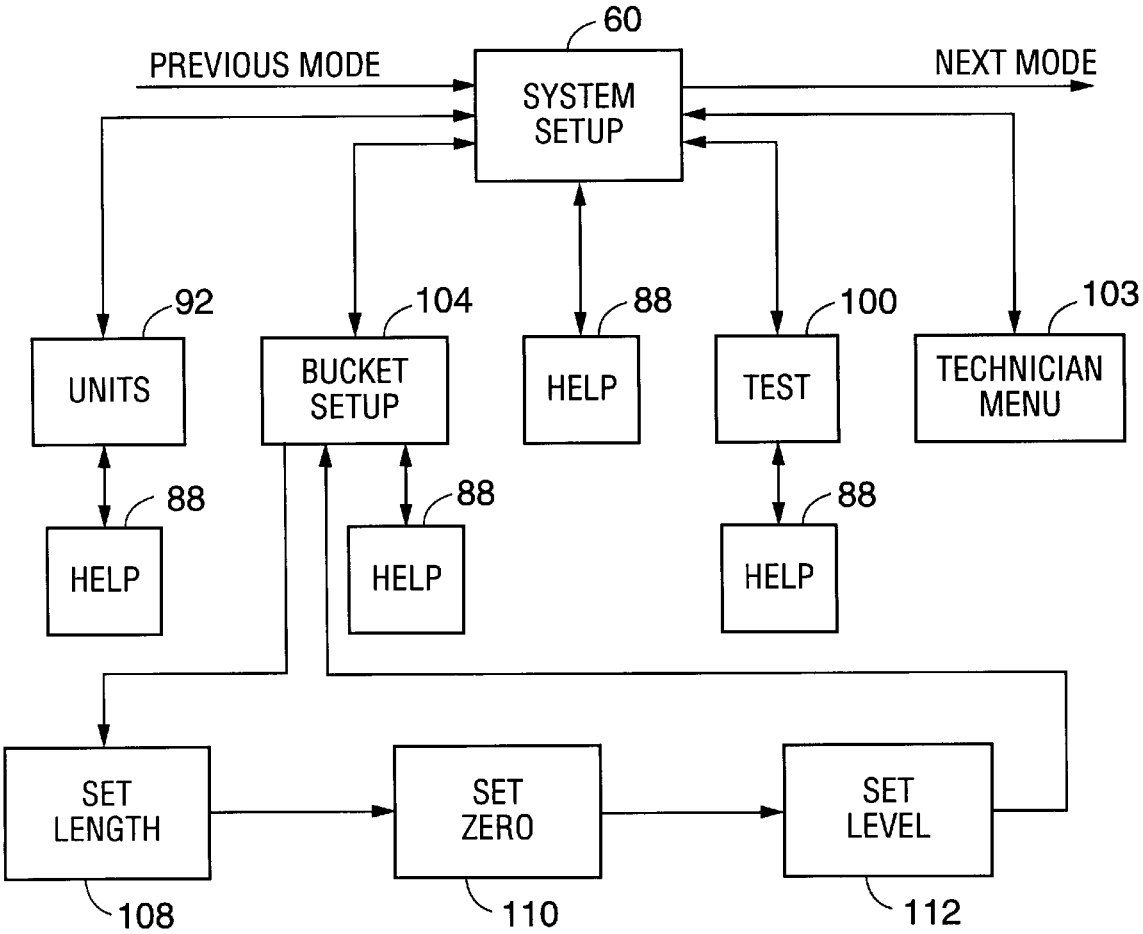
FIG. 4 is a screen diagram of a system set-up mode of operation of the present invention.
Figure 5A:
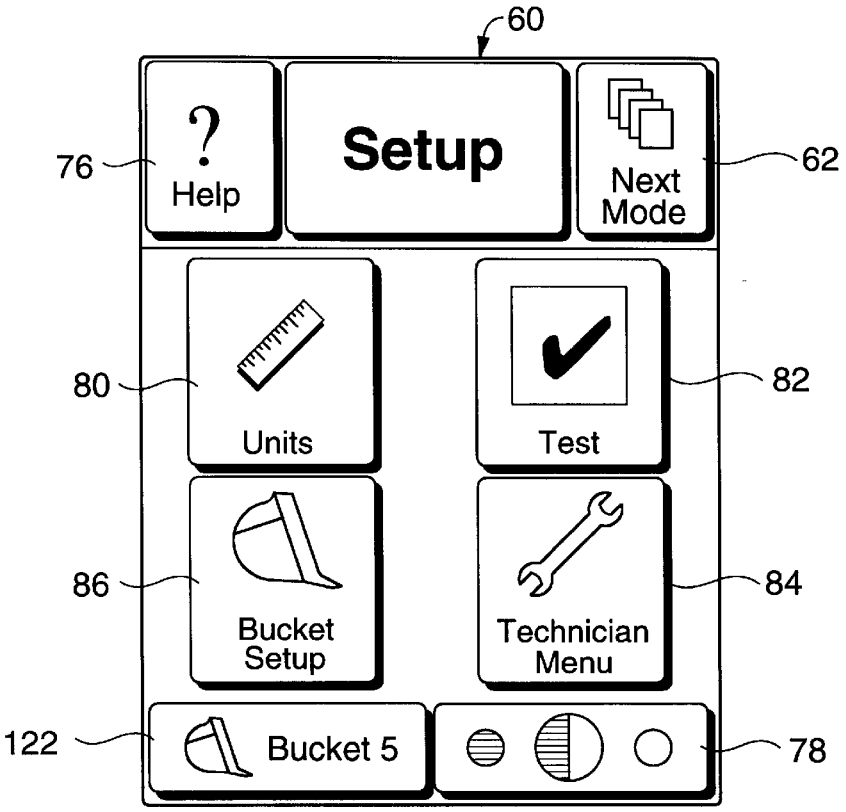
FIG. 5A is a view of a display screen used in the system set-up mode of operation.
Figure 5B:
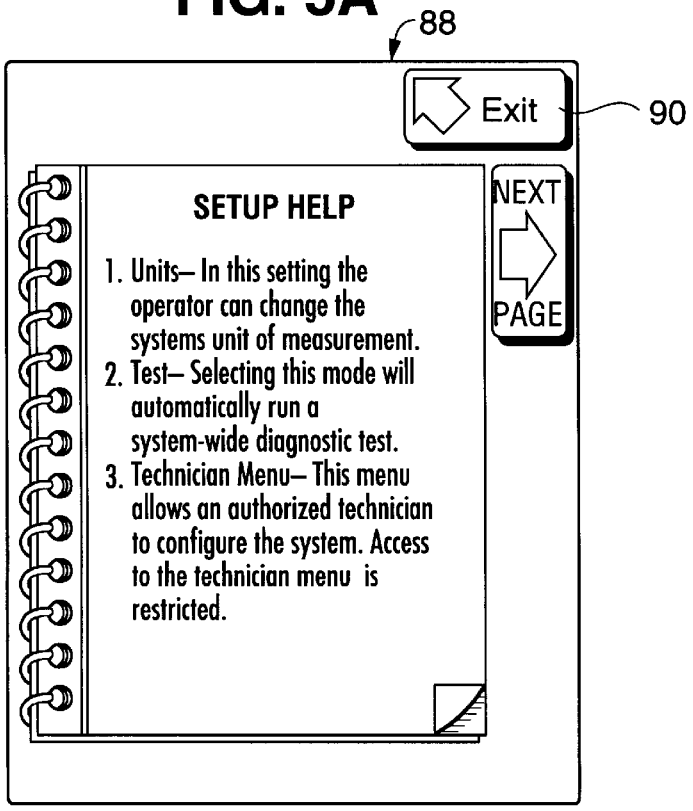
FIGS. 5B and 5C are help screens for the set-up mode of operation.
Figure 5C:
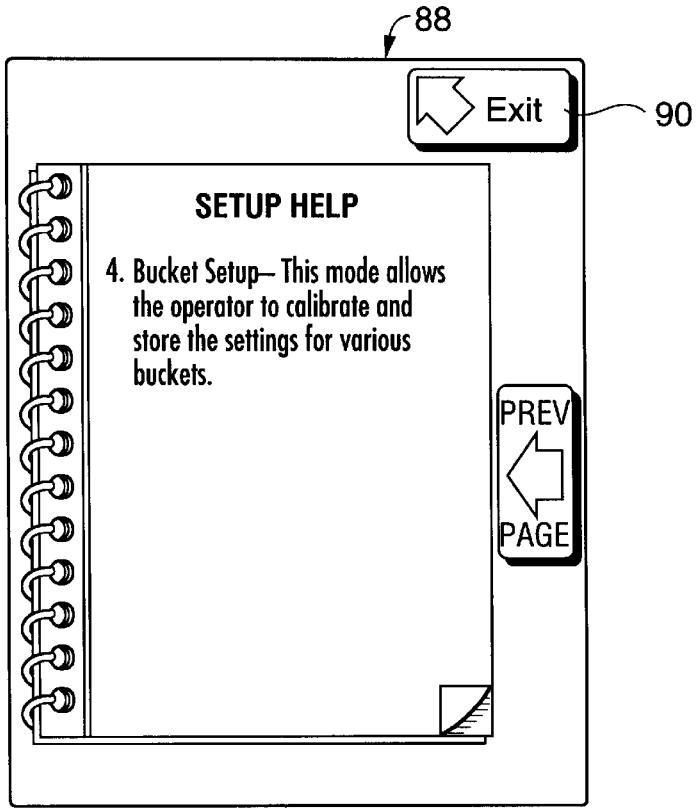
Figure 5D:
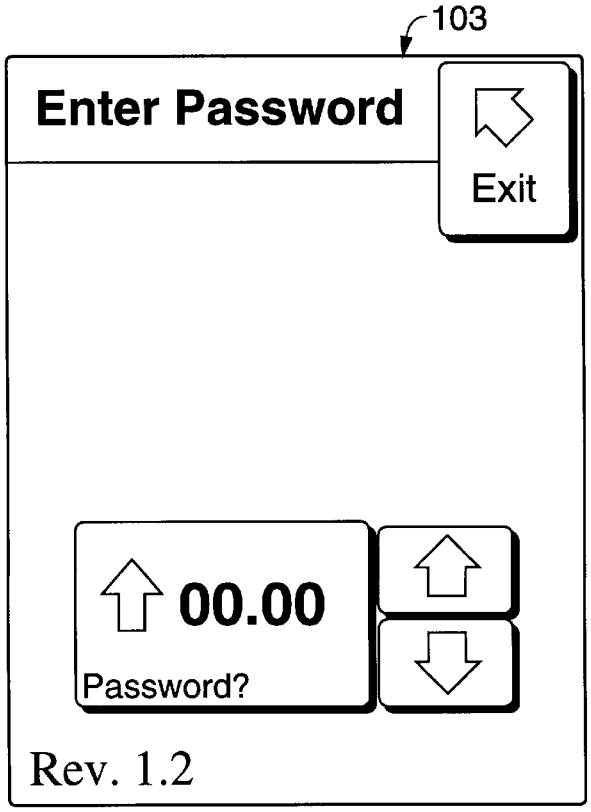
FIG. 5D is a screen that provides access by a technician.

From the system set-up menu screen 60, touching the "Next Mode" box 62 changes the screen to the slope mode set-up screen 64. Operation in the slope mode permits the operator to contour a hillside, or to dig the sloped sides of a canal, for example. FIG. 1 shows the excavator excavating a slope. As shown in FIGS. 9–11, the slope mode consists of the set-up screen 64, an indicate screen 114, and a help screen 88. FIG. 10B shows the message displayed on the help screen 88.

Figure 10A:
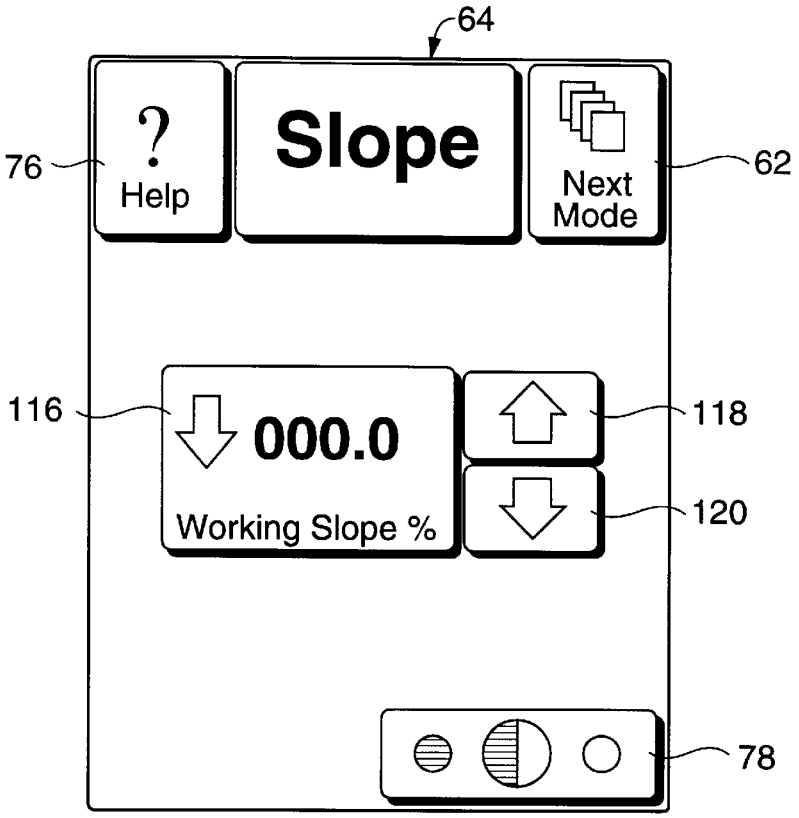
FIG. 10A is a set-up screen for the slope mode and FIG. 10B is a help screen for the slope mode.
Figure 10B:
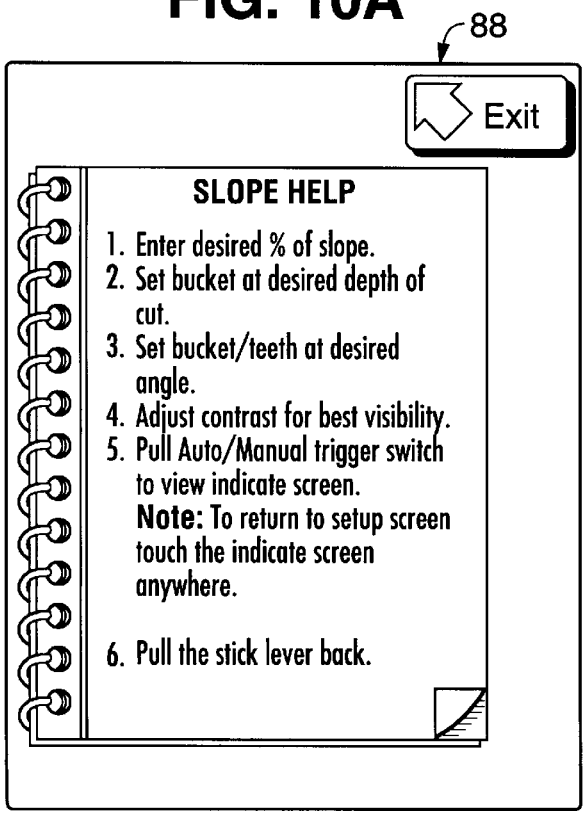

In the center of the slope mode set-up screen 64, as shown in FIG. 10A, are data entry and display boxes 116, 118, and 120. Box 116 has an arrow, a four digit number, and a label "Working Slope %." By touching display box 116, the operator can change the direction of the arrow or the value of the slope. Touching the display box 116 once causes the arrow to flash. To change the polarity of the slope, the operator touches either of the arrow boxes 118 or 120. Touching the display box 116 again causes the left-most digit to flash, and while it is flashing, touching the arrow boxes 118 or 120 will cause the value of that digit to change up or down, depending on which arrow box is touched. Touching the display box once again causes the second digit to flash and permits its value to be changed. This process is repeated until the desired value for the slope has been entered. The system will automatically accept the value entered after a slight delay with no further changes.

Once the desired slope value has been entered, the excavator is ready to excavate to create a finished surface having that slope. The operator manually positions the bucket at a desired depth of cut and adjusts the bucket angle. To begin automatic control, the operator presses the trigger switch 48, which is mounted on or near the cylinder control joysticks 49. Activating the trigger switch 48 causes the system controller to begin automatic control of the bucket to constrain the cutting edge 34 of the bucket 26 to move parallel to the desired slope 30 (FIG. 1). The operator moves the joystick 49 that controls the stick cylinder, and the machine control system 36 automatically controls the boom and bucket cylinders to move the bucket along the desired slope.

Figure 11A:
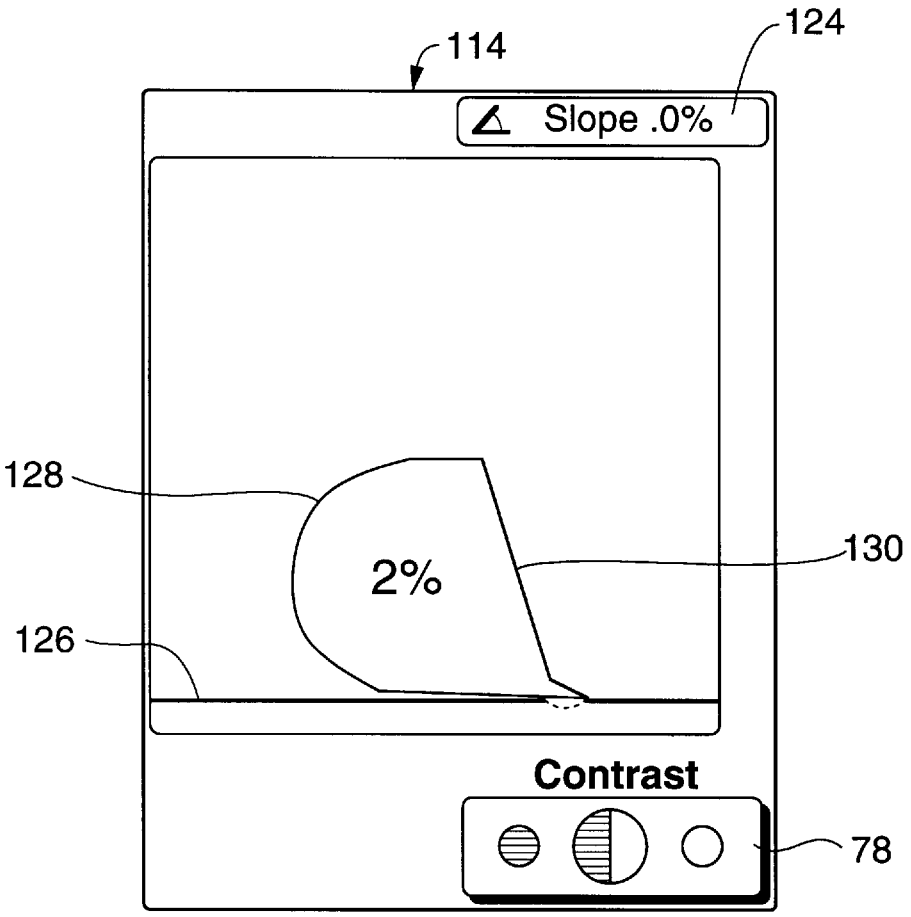
FIGS. 11A and 11B are indicate screens for the slope mode.
Figure 11B:
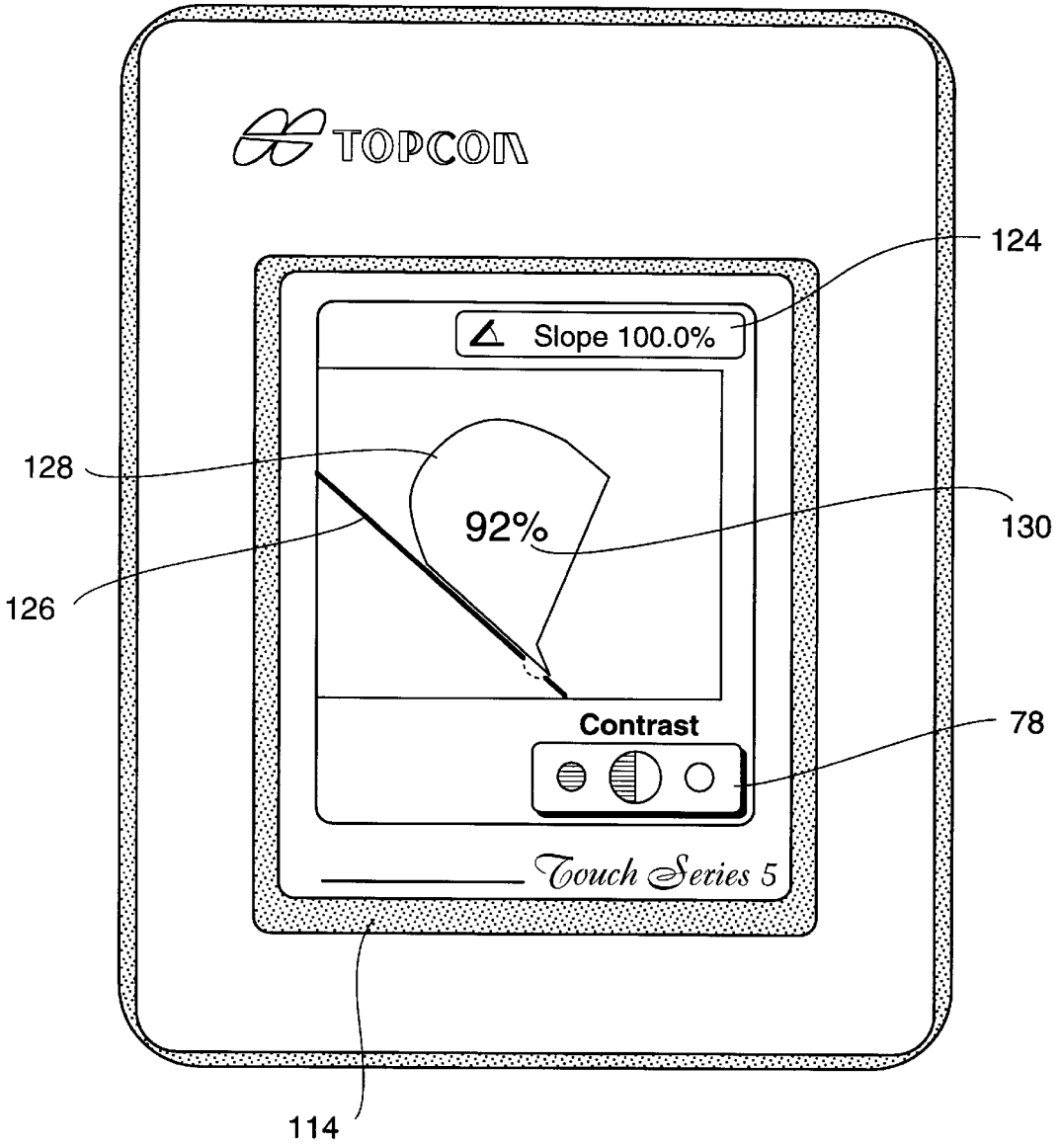
Figure 12:
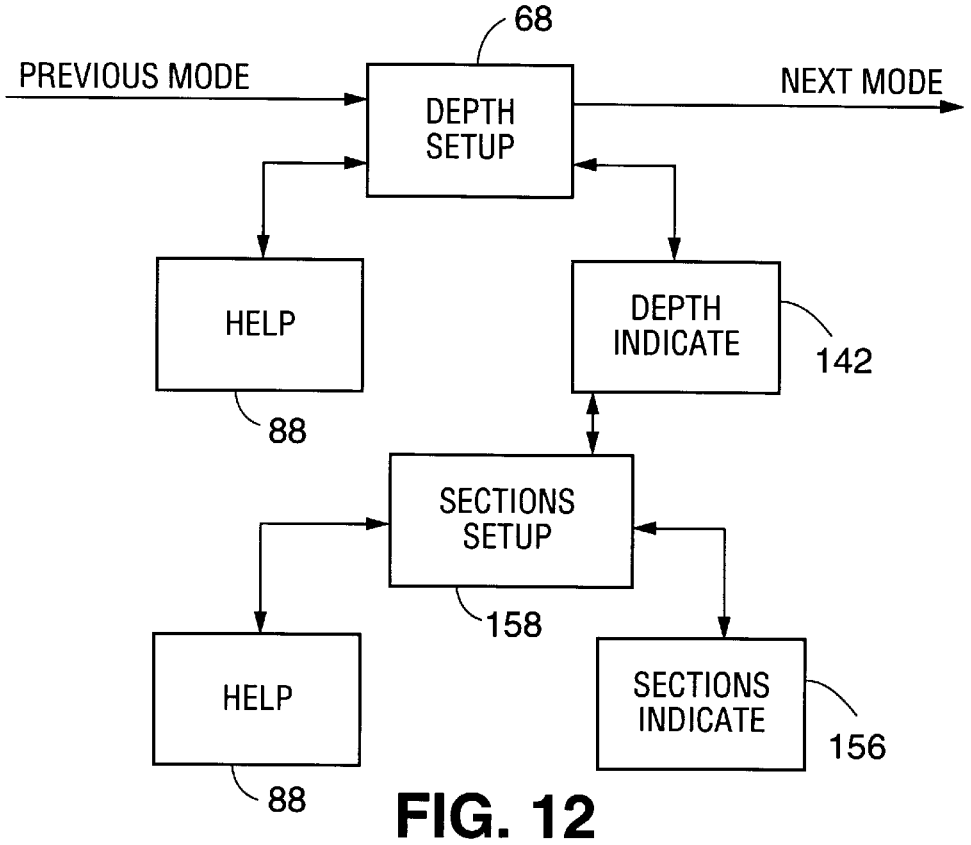
FIG. 12 is a screen diagram of a depth mode of operation of the present invention.

Activating the trigger switch also causes the control panel 46 to change screens from the set-up screen 64 to the indicate screen 114 (FIGS. 11A–B). The screen will also change to the indicate screen if five seconds elapses since the last entry activity. The indicate screen 114 has a value 124 at the top of the screen that indicates the desired slope and an inclined line 126 that visually represents the desired slope. The bucket 26 is represented graphically on the screen 114 by an icon 128 that is shaped like the profile of the bucket. A number 130 representing the measured inclination of the bottom of the bucket appears in the center of the bucket icon 128. This way the operator can see the orientation of the bucket in relation to the desired slope, and adjustments to the bucket angle can be made prior to starting automatic control. FIG. 11A shows a 0% slope, a horizontal surface, while FIG. 11B shows a 100% slope, a surface inclined at 45 degrees.

When the cut is completed, the operator needs to dump the load in the bucket. The trigger switch is released by the operator, which takes the excavator out of automatic control, and allows operator to manually control the bucket to dump it. Thereafter, the operator can take additional cuts at the same slope, or change the desired slope value, or move the excavator, as appropriate.

Figure 13A:
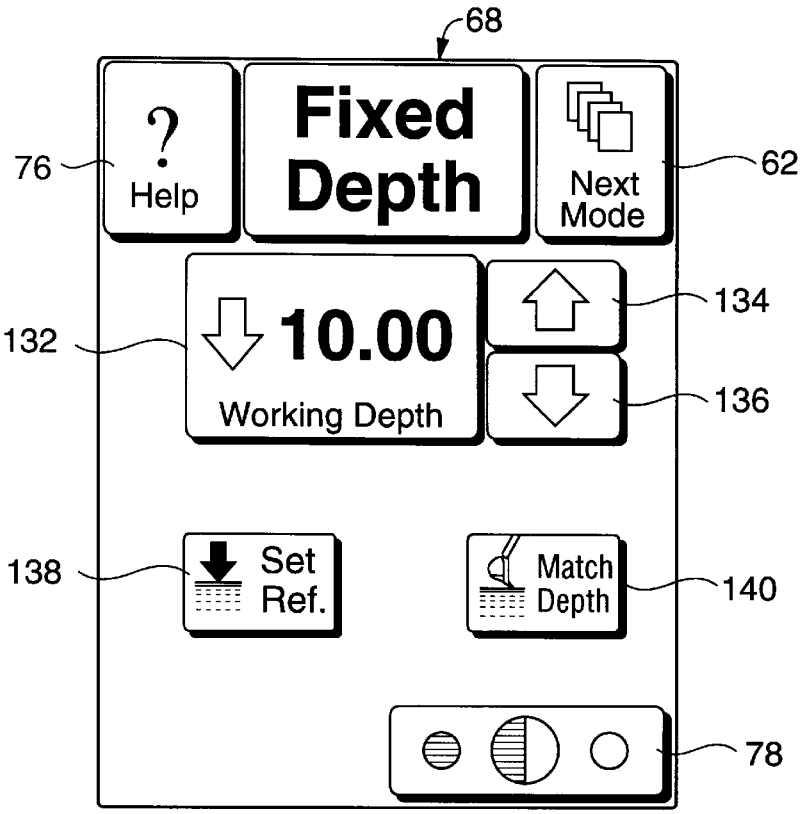
FIG. 13A is a set-up screen for the depth mode and FIG. 13B is a help screen for the depth mode.
Figure 13B:
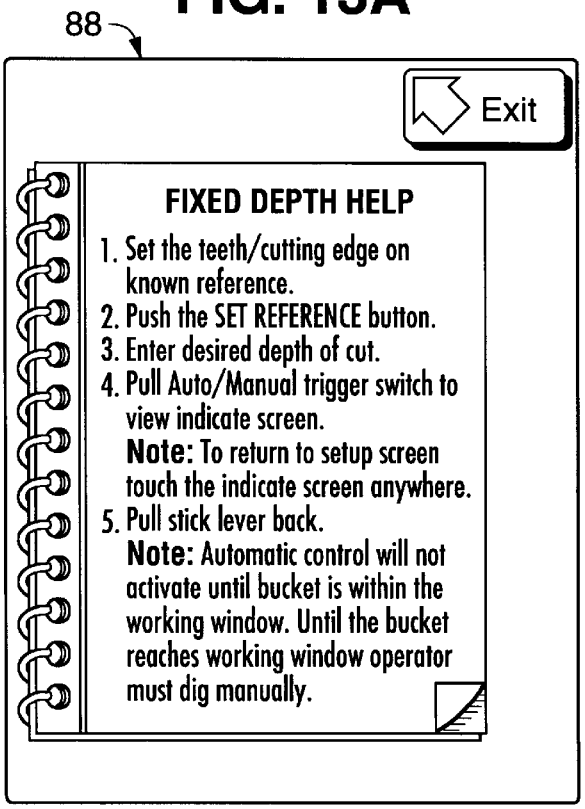
Figure 14:
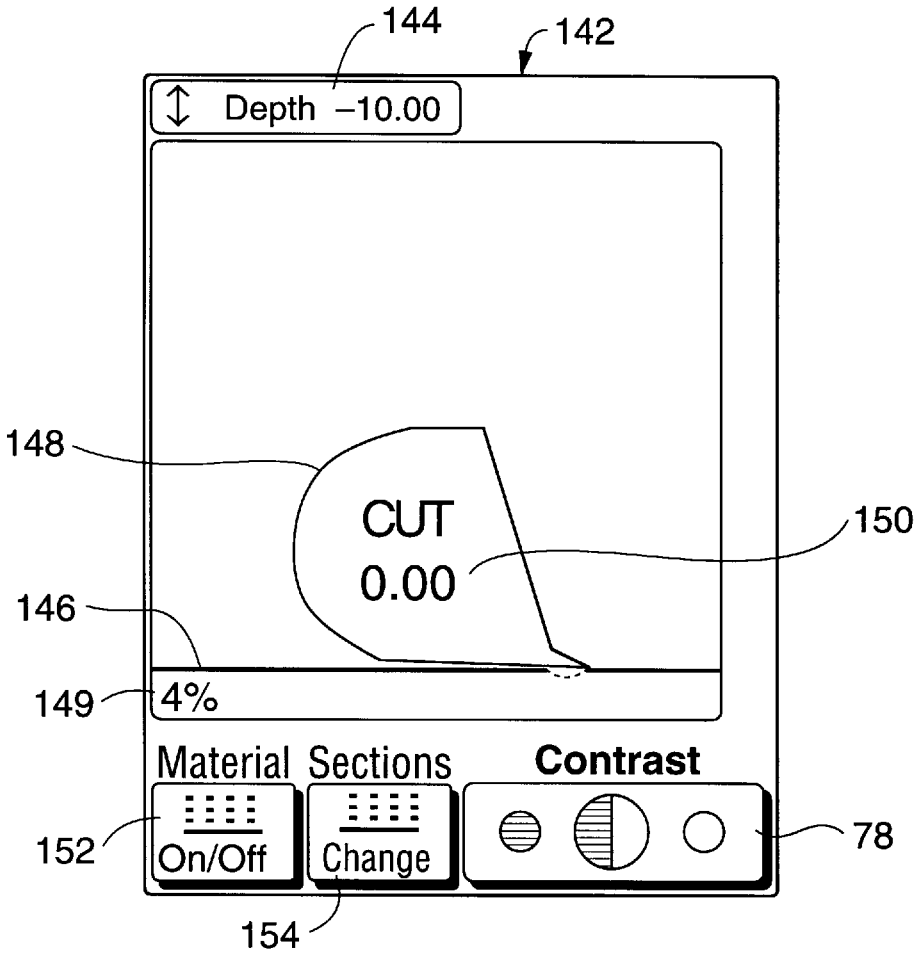
FIG. 14 is an indicate screen for the depth mode.

Another mode of operation is excavating to a fixed depth. When the operator wants to cut a fixed depth, the "Next Mode" box 62 is touched until the depth mode set-up screen 68 appears. (FIG. 13A) The operation of the present invention in the depth mode is illustrated in FIGS. 12–15. The depth mode set-up screen 68 has three data entry and display boxes 132, 134, and 136 like the data entry and display boxes 116, 118, and 120 of the slope set-up screen (FIG. 10A). The boxes are touched by the operator until the value of the desired depth of cut is displayed. FIG. 13B shows the help screen message for the depth mode.

Depth is defined with respect to some reference elevation, and the depth mode set-up screen 68 provides two ways of setting the reference. A "Set Ref." box 138 on the set-up screen 68 permits the operator to define the digging depth with respect to ground level or other known reference. The operator positions the bucket so that the cutting edge is at ground level or at another known reference and then touches the "Set Ref." box 138. This procedure zeros the depth measurement at that position, so that the desired depth input on the set-up screen 68 is measured relative to that reference. If the excavator is moved between digging passes, it is recommended that the depth reference be reestablished to preserve the accuracy of the excavation.

The second method of setting the depth reference is to position the bucket to the desired depth of the cut and then touch a "Match Depth" box 140 on the set-up screen 68. This will instruct the machine control system 36 that the desired depth of cut is at that position of the bucket. When the "Match Depth" box is pressed, the system then ignores the displayed value of the desired depth. The "Match Depth" mode is especially useful for matching the excavation to a prior cut, such as after repositioning the excavator.

Figure 15A:
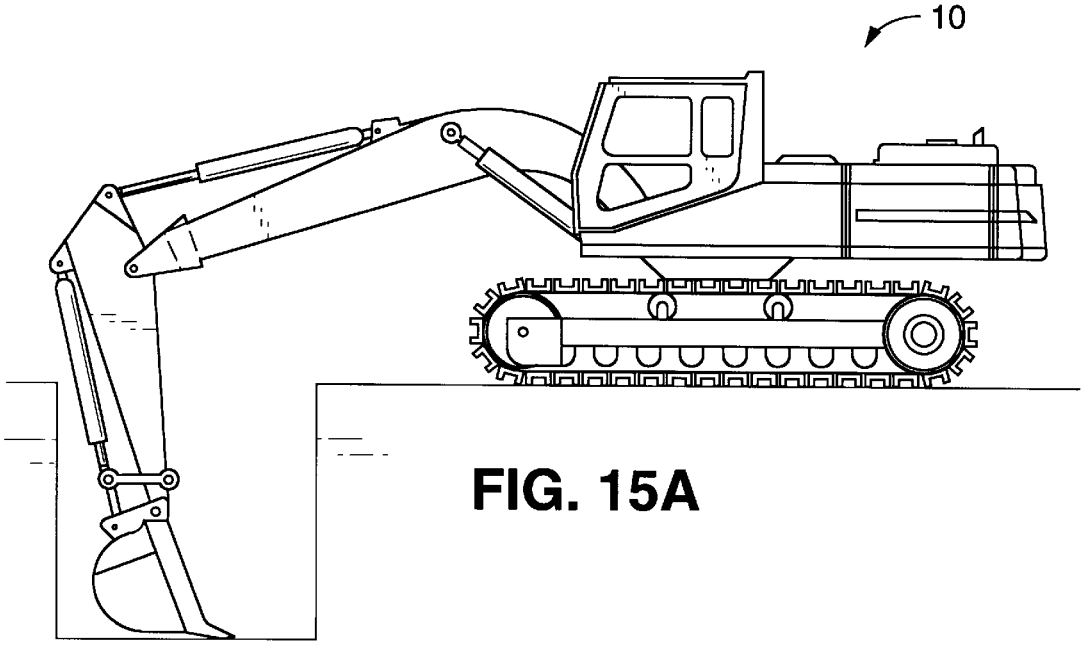
FIGS. 15A and 15B are side elevation views of an excavator grading a fixed depth.
Figure 15B:
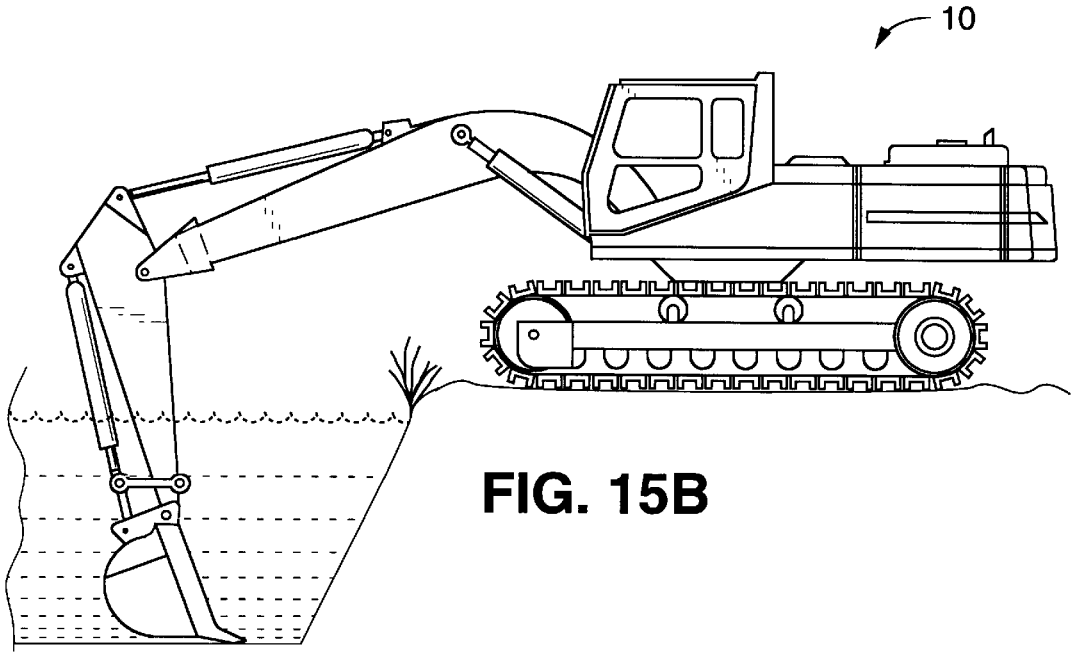

Once the desired depth has been entered and the reference established, then the system is ready for excavating in a fixed-depth mode. Again, the operator initiates automatic control by activating the trigger switch 48. This causes the machine control system 36 to begin its automatic control of the bucket and also changes the display to a depth indicate screen 142, shown in FIG. 14. The indicate screen 142 has a value 144 at the top of the screen that indicates the desired depth and a line 146 that visually represents the desired depth. The bucket 26 is represented graphically on the screen 142 by a bucket icon 148. A number 150 representing the measured position of the cutting edge 34 of the bucket 26 relative to the desired depth appears in the center of the bucket icon 148. The work "Cut" or "Fill" appears in the bucket icon to indicate whether the bucket is above or below the desired grade. A value 149 below the bucket icon 150 indicates the slope of the bottom of the bucket. FIGS. 15A and 15B show the excavator 10 excavating in the fixed depth mode to dig a flat-bottomed surface. FIG. 15B shows that a fixed depth excavation is possible even if the cut is under water or otherwise not visible to the operator.

The depth indicate screen 142 also has boxes 152 and 154 at the bottom for entry into another mode of operation—material sections. Touching an "On/Off" box 152 causes the screen to change to a material sections indicate screen 156 (FIG. 17), while touching a "Change" box 154 causes the screen to change to a material sections set-up screen 158 (FIG. 16).

Sometimes an excavation job requires digging down to a certain depth, and then backfilling with bedding material, laying pipe on the bedding material, covering the pipe with cover material, and then backfilling with still more material. The material sections mode permits the operator to define multiple depths and to choose which of those depths will govern the automatic control of the excavator.

Figure 16:
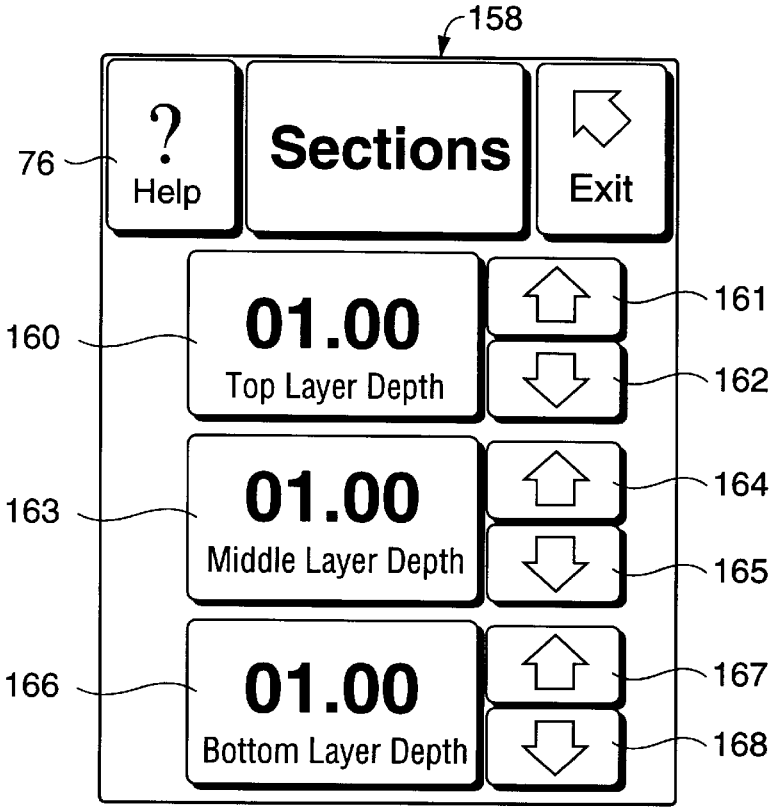
FIG. 16 is a set-up screen for a multiple-sections mode of operation of the present invention.
Figure 17:
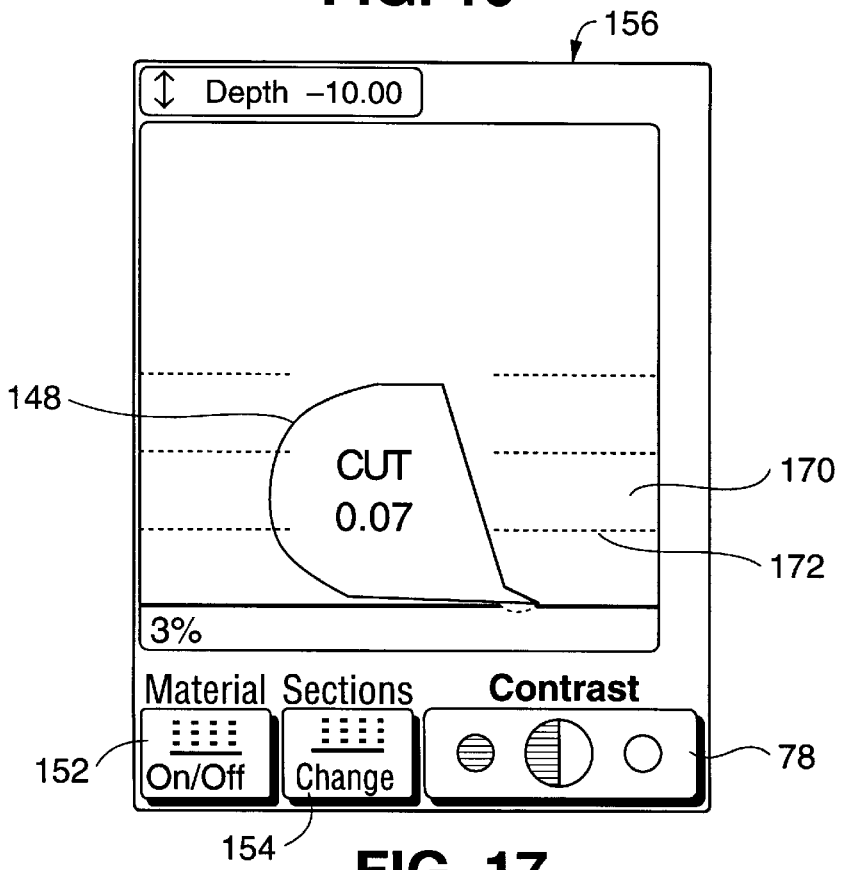
FIG. 17 is an indicate screen for the multiple-sections mode.

As shown in FIG. 16, entry into the material sections set-up screen 158 permits the entry of data to define three depths of fill material above the depth established by the depth mode screen 142. These depths are entered and indicated by boxes 160–168 in the same manner as described above. The values indicated in the material sections set-up screen are the thicknesses of the layers. Once the layer depths are input, the operator activates the trigger switch 48, which causes the machine control system 36 to begin automatic control and also causes the material sections indicate screen 156 to appear (FIG. 17). Screen 156 is similar to the depth indicate screen 142 (FIG. 14), but with the addition of lines indicating the material sections. The value in the bucket icon 148 indicates the position of the bucket relative to the line immediately below it. When the bucket is raised into the middle layer 170, for example, the line 172 will be solid instead of dashed and the value in the bucket icon will indicate the position of the bucket relative to that level.

Figure 18:
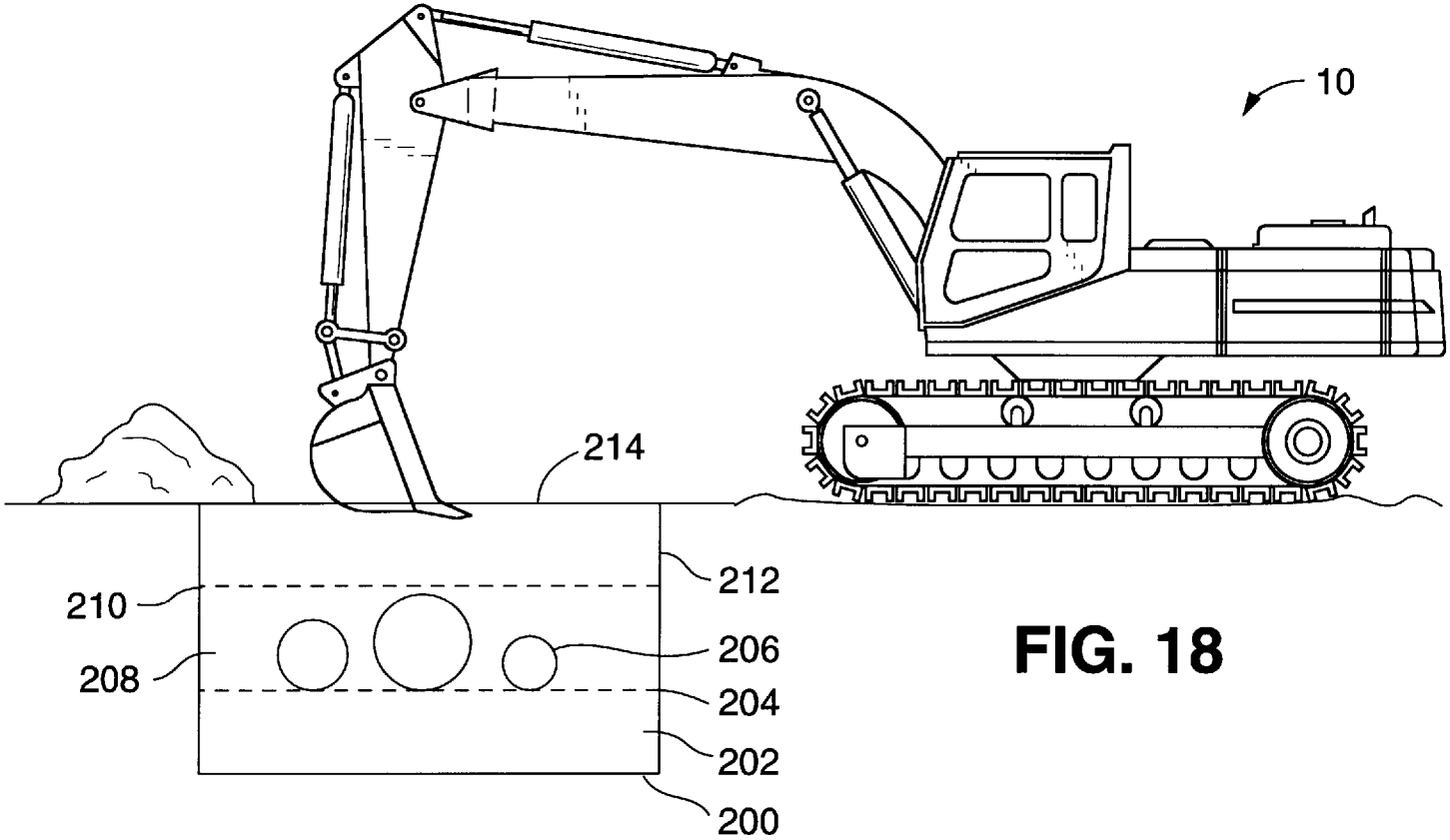
FIG. 18 is a side elevation view of an excavator operating in multiple-sections mode.

FIG. 18 illustrates the excavator 10 filling in a trench using the material sections mode of operation. An excavation job may require digging a trench down to a certain depth 200, and then backfilling with bedding material 202 to another depth 204, then laying pipe 206 on the bedding material and covering the pipe with cover material 208 to another depth 210, and then backfilling with still more material 212 to yet another depth 214. Operating in the material selections mode allows the operator to automatically excavate to the depth 200, then backfill to depth 204 with bedding material, then backfill to depth 210 with cover material, and then backfill to depth 214 with a top layer of material, all under automatic control.

Figure 19:
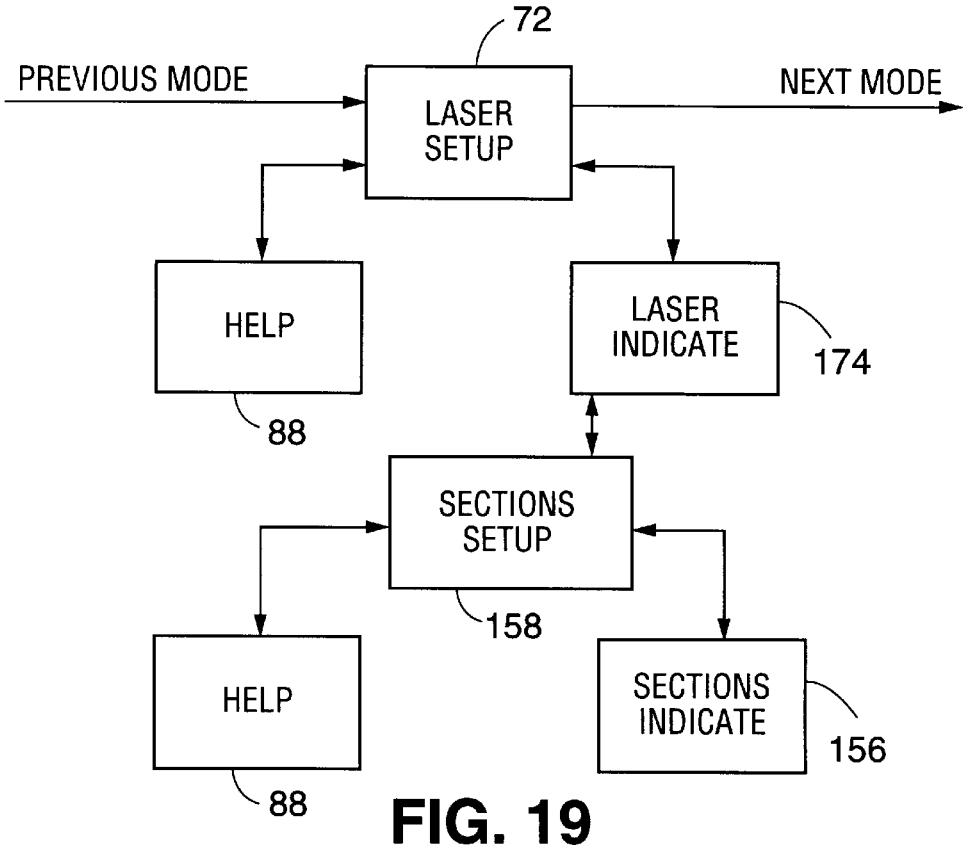
FIG. 19 is a screen diagram of a laser mode of operation of the present invention.
Figure 24:
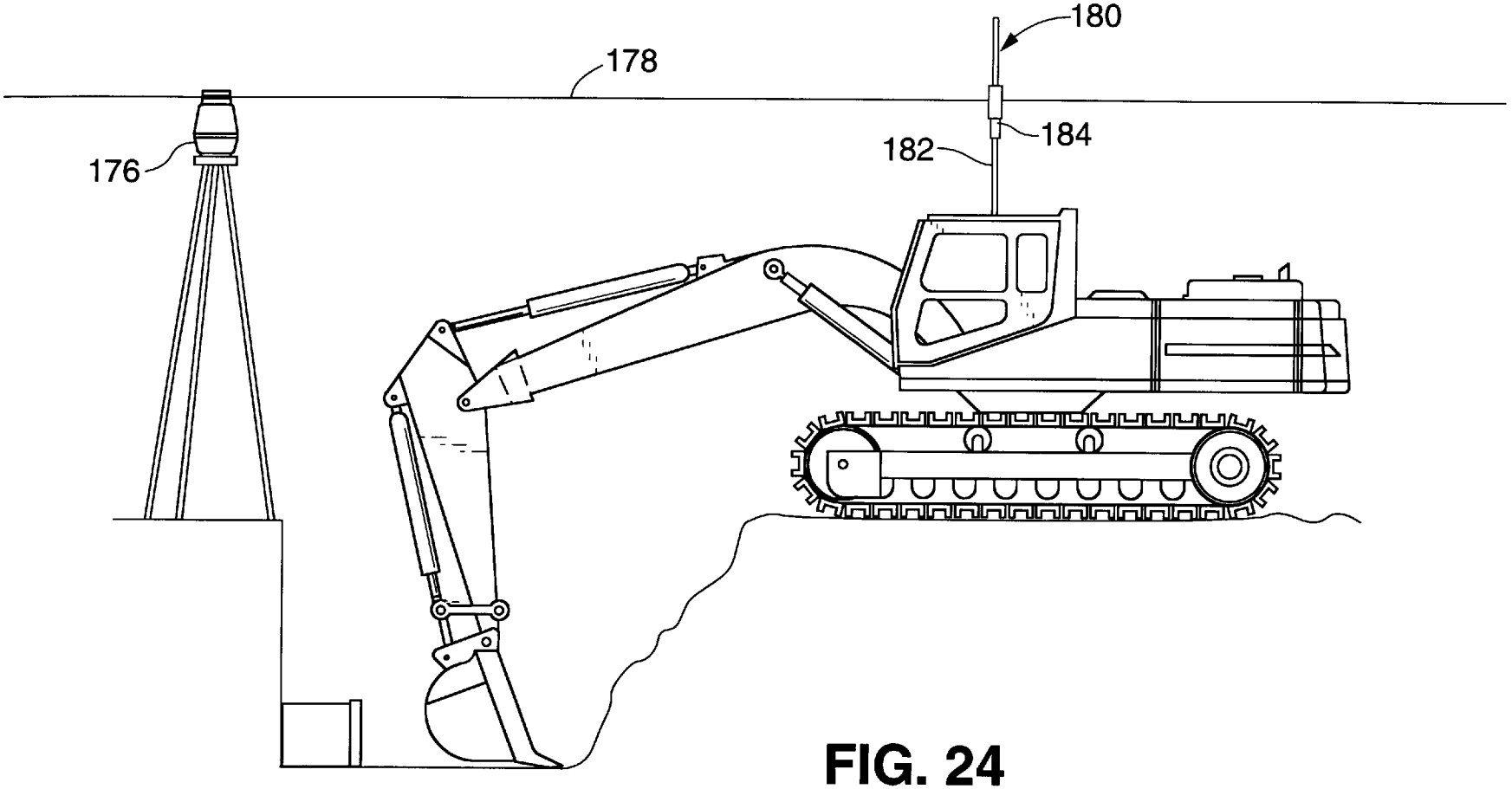
FIG. 24 is a side elevation view of an excavator operating in laser mode.

Another mode of operation, laser mode, is illustrated in FIGS. 19–24. The operation of the laser mode is similar to that of the depth mode in that the material sections mode can be accessed from the laser-mode indicate screen 174, as shown in FIG. 19. As shown in FIG. 24, the laser mode requires two additional pieces of equipment. One is a laser transmitter 176 that generates a laser reference beam 178, typically a rotating or fan-sweeping beam. The laser reference beam 178 is preferably set at the same slope as the bottom of the excavated surface, either horizontal or at an angle. The second additional piece of equipment is a laser receiver 180 that is mounted on the excavator 10. The laser receiver has a mast 182 and a travelling sensor 184 that moves up or down the mast until it senses the laser reference beam 178. The laser receiver feeds data indicating the elevation of the laser reference beam to the system controller 44, which uses that data for its depth reference.

Figure 20:
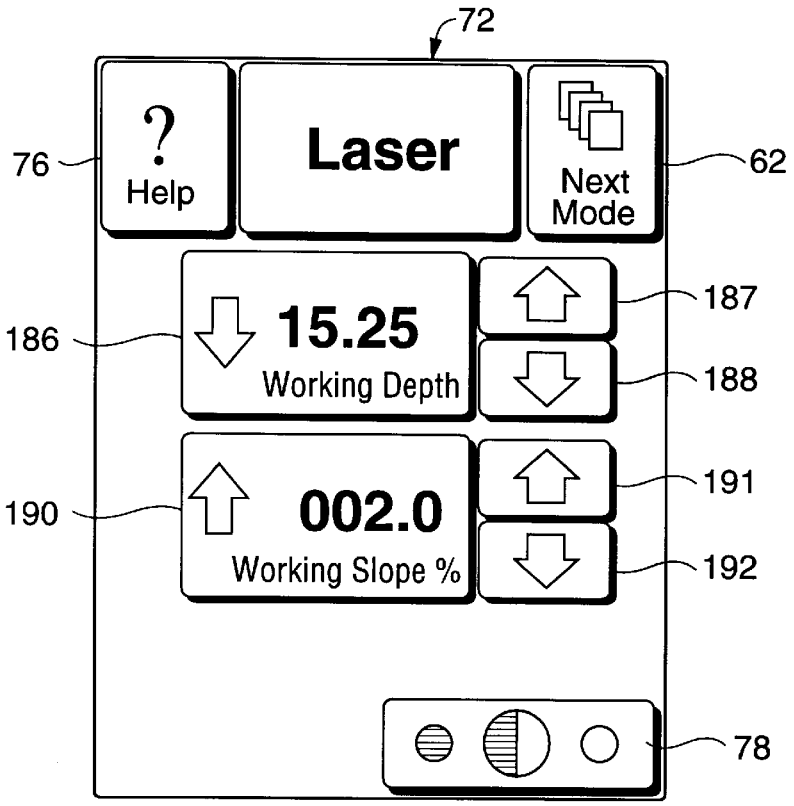
FIG. 20 is a set-up screen for the laser mode.

The laser mode set-up screen 72, shown in FIG. 20, has one set of data entry and display boxes 186–188 that permits the operator to input the desired depth of the excavated surface relative to the laser reference beam 178. The set-up screen 72 also has another set of data entry and display boxes 190–192 that permits the operator to input the desired slope of the excavated surface. If the slope is zero, then the defined cut is horizontal at the desired depth. If the slope is not zero, then the cut is defined by the line that runs at the desired slope through a point determined by the desired depth at a point in vertical alignment with the pivot point 17 of the boom.

Figure 21:
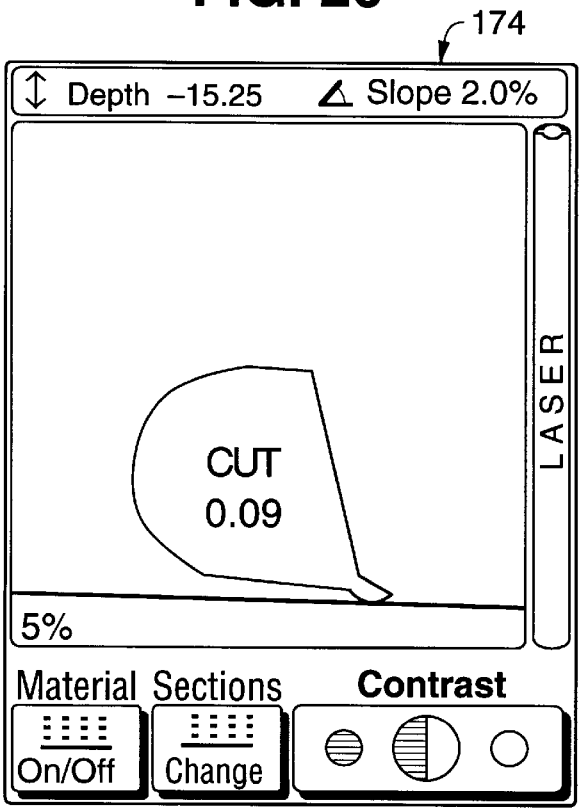
FIG. 21 is an indicate screen for the laser mode.
Figure 22:
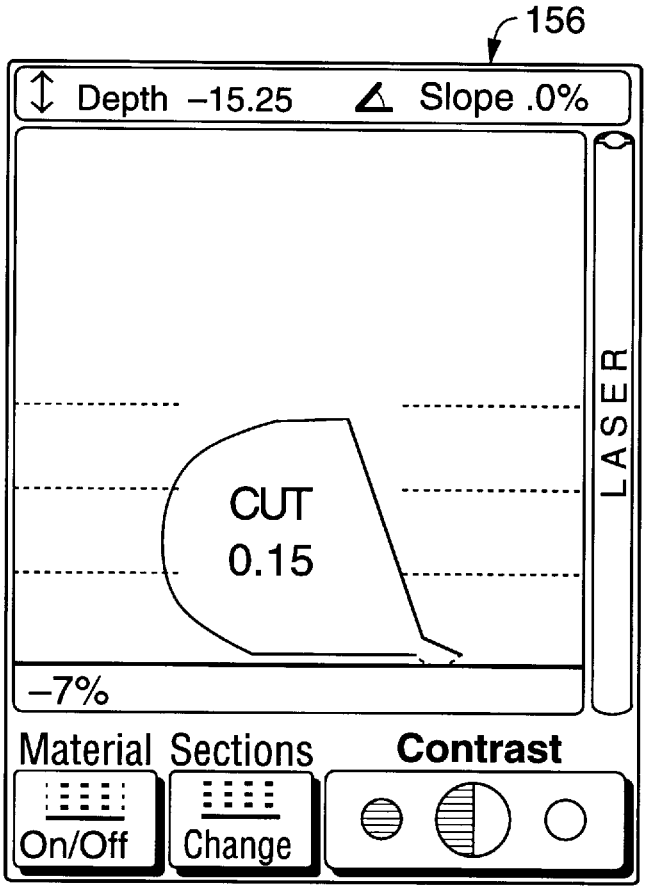
FIG. 22 is another indicate screen for the laser mode, also showing multiple sections.
Figure 23A:
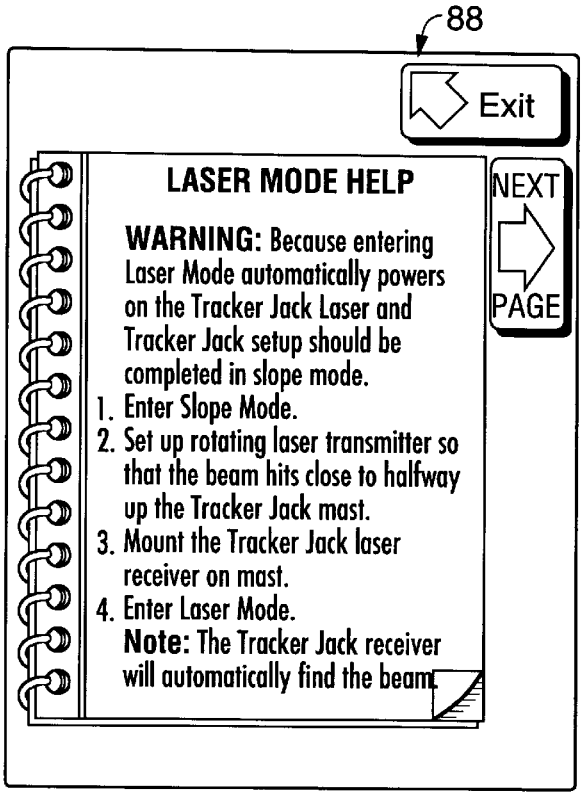
FIG. 23A, 23B, and 23C are help screens for the laser mode.
Figure 23B:
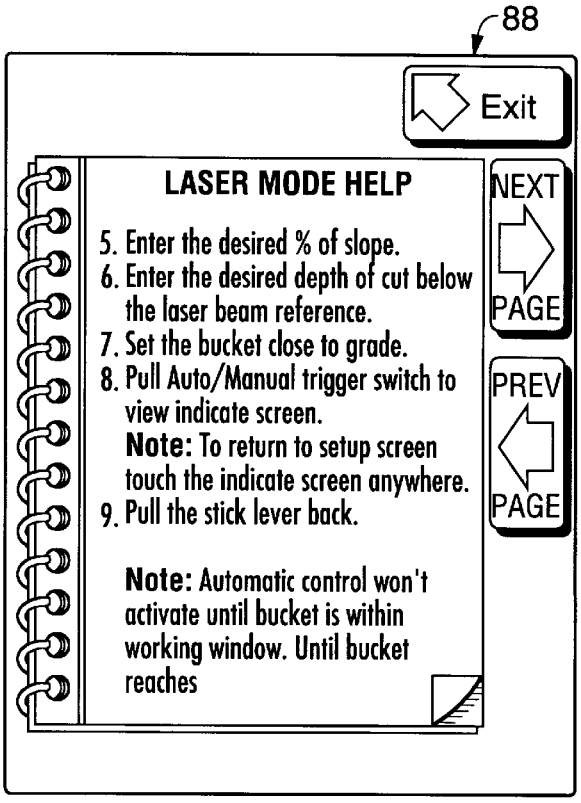
Figure 23C:
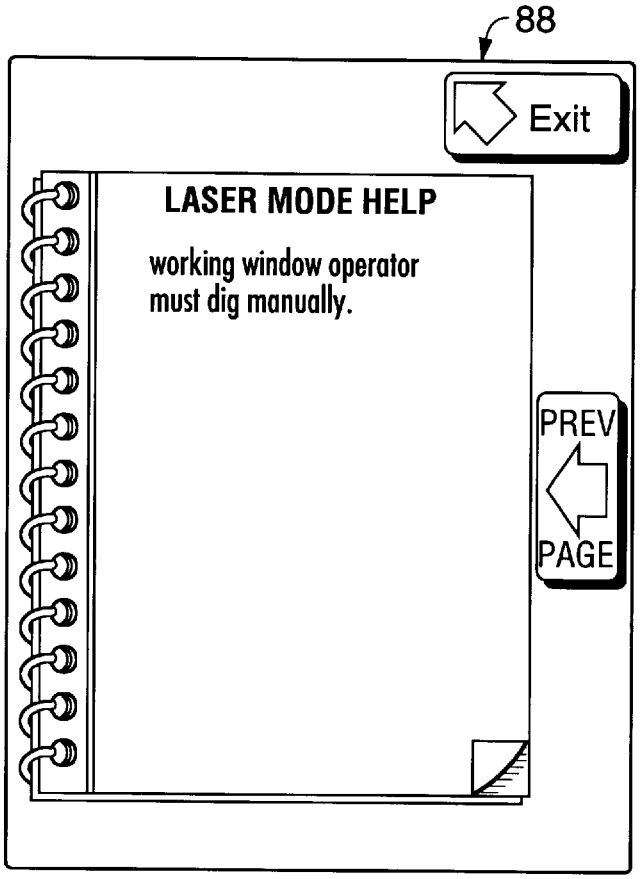

After the parameters have been input, the operation in laser mode is similar to that in depth mode. FIG. 21 shows the indicate screen 174 for depth-mode operation, while FIG. 22 shows the indicate screen 156 for operation in the multiple-sections mode. Help screens 88 for the laser mode are shown in FIG. 23.

From the above description, it will be apparent that the invention disclosed herein provides a novel and advantageous method of using a touch screen control panel to input and display data to control excavation by an excavator. The foregoing discussion discloses and describes merely exemplary methods and embodiments of the present invention. As will be understood by those familiar with the art, the invention may be embodied in other specific forms without departing from the spirit or essential characteristics thereof. For example, the term "touch-sensitive" has been used to describe the display panel used with the method of the present invention. This term is not intended to be limited to only panels requiring that the operator physically touch the panel and is not intended to exclude display panels that rely on proximity rather that actual physical contact. Accordingly, the disclosure of the present invention is intended to be illustrative, but not limiting, of the scope of the invention, which is set forth in the following claims.

What is claimed is:

1. A method for inputting commands for controlling an excavator to excavate a surface to a desired contour, wherein the excavator has an excavator bucket, and wherein the method comprises the steps of:

providing a display panel with a touch-sensitive screen at a position accessible to an operator, wherein the display panel provides a means for inputting control data to a machine control system coupled to the excavator;

inputting data by touching the display panel to define a desired contour of the excavated surface;

displaying on the display panel information representing the position of the excavator bucket relative to the desired contour of the excavated surface; and controlling movement of the excavator bucket to excavate the desired contour of the excavated surface.

2. A method as recited in claim 1 wherein the desired contour is a slope of the excavated surface, and wherein the step of inputting data defines a desired slope of the excavated surface.

3. A method as recited in claim 2 wherein the step of inputting data includes touching the display panel at a defined location to change a digital display of a value representing the desired slope.

4. A method as recited in claim 2 wherein the step of displaying includes displaying a representation of the desired slope and a representation of the excavator bucket.

5. A method as recited in claim 4 wherein the step of displaying includes displaying a value corresponding to the desired slope and displaying a line oriented at an angle corresponding to the desired slope.

6. A method as recited in claim 4 wherein the step of displaying includes displaying a value corresponding to the slope of a bottom surface of the excavator bucket and displaying a graphical representation of the orientation of the excavator bucket.

7. A method as recited in claim 1 wherein the desired contour is a depth of the excavated surface, and wherein the step of inputting data defines a desired depth of the excavated surface.

8. A method as recited in claim 7 wherein the step of inputting data includes touching the display panel at a defined location to change a digital display of a value representing the desired depth.

9. A method as recited in claim 7 wherein the step of displaying includes displaying a representation of the desired depth and a representation of the excavator bucket.

10. A method as recited in claim 9 wherein the step of displaying includes displaying a value corresponding to the desired depth.

11. A method as recited in claim 9 wherein the step of displaying includes displaying a value corresponding to the depth of the excavator bucket relative to the desired depth.

12. A method as recited in claim 9 wherein the step of displaying includes displaying a graphical representation of the position of the excavator bucket with respect to the desired depth.

13. A method as recited in claim 7 further comprising the step of positioning the excavator bucket at a reference position and then touching the display panel at a defined location to set a reference elevation of the bucket, wherein the depth of the bucket is measured with respect to the reference position.

14. A method as recited in claim 7 further comprising the step of positioning the excavator bucket at a reference position and then touching the display panel at a defined location to set the desired depth of the bucket equal to the reference position.

15. A method as recited in claim 1 wherein the excavated surface includes a plurality of surfaces at different depths, and wherein the step of inputting data defines a desired depth of each of the plurality of surfaces.

16. A method as recited in claim 15 wherein the step of inputting data includes touching the display panel at defined locations to change a digital display of values representing the desired depths of the plurality of surfaces.

17. A method as recited in claim 15 wherein the step of displaying includes displaying a representation of the desired depths of the plurality of surfaces and a representation of the excavator bucket.

18. A method as recited in claim 17 wherein the step of displaying includes displaying values corresponding to the desired depths of the plurality of surfaces.

19. A method as recited in claim 17 wherein the step of displaying includes displaying a value corresponding to the depth of the excavator bucket relative to the desired depths of the plurality of surfaces.

20. A method as recited in claim 17 wherein the step of displaying includes displaying a graphical representation of the position of the excavator bucket with respect to the desired depths of the plurality of surfaces.

21. A method as recited in claim 1 wherein the step of inputting data includes displaying a first screen containing a display of the data, and wherein the step of displaying information representing the desired contour includes displaying a second screen containing a display of a graphical representation of the bucket indicating the position of the bucket with respect to the desired contour of the excavated surface.

22. A method as recited in claim 21 wherein the operator toggles between the first screen and second screen by activating and deactivating a trigger switch.

23. A method as recited in claim 22 wherein pressing the trigger switch activates an automatic mode of controlling the movement of the excavator bucket.

24. A method as recited in claim 1 further comprising the steps of providing a trigger switch accessible to the operator, and initiating automatic control of the excavation by activating the trigger switch.

25. A method as recited in claim 1 wherein the desired contour is either a slope or a depth of the excavated surface, and wherein selecting between a desired slope and a desired depth includes touching the display panel at a defined location to switch between a screen corresponding to slope control and a screen corresponding to depth control.

26. A method as recited in claim 1 further including the step of providing a laser elevation reference by means of a laser transmitter that outputs a laser beam at a known planar orientation and by means of a laser receiver mounted to the excavator that detects the laser beam and determines the elevation of the excavator with respect to the laser beam.

27. A method as recited in claim 26 wherein the desired contour is a depth of the graded surface, and wherein the step of inputting data defines a desired depth of the graded surface with respect to the laser beam.

28. A method as recited in claim 27 wherein the step of inputting data includes touching the display panel at a defined location to change a digital display of a value representing the desired depth of the excavated surface with respect to the laser beam.

29. A method as recited in claim 26 wherein the desired contour is a slope of the excavated surface, and wherein the step of inputting data defines an elevation of a reference point with respect to the laser beam, and the step of inputting data further defines a desired slope of the excavated surface along a line passing through the reference point.

30. A method as recited in claim 29 wherein the step of inputting data includes touching the display panel at a defined location to change a digital display of a value representing the desired slope of the excavated surface and touching the display panel at another defined location to change a digital display of a value representing the elevation of the reference point with respect to the laser beam.

31. A method as recited in claim 1 further comprising the step of defining characteristics of the excavator bucket by touching the display panel to input data representing the bucket.

32. A method as recited in claim 31 further comprising the steps of defining characteristics of multiple excavator buckets, and selecting between the multiple excavator buckets by touching the display panel.

33. A method as recited in claim 31 wherein the step of defining characteristics of the excavator bucket includes inputting data representing a length between a pivot attachment of the bucket and a cutting edge of the bucket by entering a digital value by touching the display panel, includes defining a first reference position of the bucket by orienting the bucket so that the cutting edge is vertically aligned with the pivot attachment and touching the display panel, and further includes defining a second reference position of the bucket by orienting the bucket so that a bottom surface of the bucket is horizontal and touching the display panel.

34. A method for inputting commands for controlling an excavator to excavate a surface to a desired slope or depth, wherein the excavator has an excavator bucket, and wherein the method comprises the steps of:

providing a display panel with a touch-sensitive screen at a position accessible to an operator, wherein the display panel provides a means for inputting control data to a machine control system coupled to the excavator;

providing a trigger switch;

selecting between a slope-control mode and a depth-control mode by touching the display panel;

if slope-control mode is selected, then;

inputting data by touching the display panel to define a desired slope of the excavated surface;

displaying on the display panel information representing the desired slope of the excavated surface;

actuating the trigger switch;

displaying on the display panel information representing the position of the excavator bucket relative to the desired slope; and automatically controlling the path of the excavator bucket to match the desired slope;

if depth control mode is selected, then;

inputting data by touching the display panel to define a desired depth of the excavated surface;

displaying on the display panel information representing the desired depth of the excavated surface;

actuating the trigger switch;

displaying on the display panel information representing the position of the excavator bucket relative to the desired depth; and automatically controlling the path of the excavator bucket to match the desired depth.

* * * * *